US007779558B2

(12) United States Patent
Nishiwaki et al.

(10) Patent No.: US 7,779,558 B2
(45) Date of Patent: Aug. 24, 2010

(54) SHOCK ABSORBING DEVICE FOR SHOE SOLE

(75) Inventors: Tsuyoshi Nishiwaki, Kobe (JP); Hisanori Fujita, Kobe (JP); Kiyomitsu Kurosaki, Kobe (JP)

(73) Assignee: ASICS Corporation, Kobe (JP)

( * ) Notice: Subject to any disclaimer, the term of this patent is extended or adjusted under 35 U.S.C. 154(b) by 858 days.

(21) Appl. No.: 11/631,532

(22) PCT Filed: Jul. 4, 2005

(86) PCT No.: PCT/JP2005/012326

§ 371 (c)(1),
(2), (4) Date: Jan. 4, 2007

(87) PCT Pub. No.: WO2006/038357

PCT Pub. Date: Apr. 13, 2006

(65) Prior Publication Data

US 2008/0034615 A1 Feb. 14, 2008

(30) Foreign Application Priority Data

Sep. 30, 2004 (JP) ..... 2004-286577

(51) Int. Cl.
*A43B 13/28* (2006.01)

(52) U.S. Cl. ..... 36/27; 36/28

(58) Field of Classification Search ..... 36/28, 36/27, 30 R, 29, 35 R
See application file for complete search history.

(56) References Cited

U.S. PATENT DOCUMENTS 1,278,320 A 9/1918 Ellithorpe
1,344,972 A 9/1919 Armour
2,303,744 A 12/1942 Jacobs
2,423,753 A 7/1947 Brooks
4,364,188 A 12/1982 Turner et al.
4,616,431 A 10/1986 Dassler
4,680,875 A 7/1987 Danieli
4,730,402 A 3/1988 Norton
4,748,750 A 6/1988 George
4,843,737 A * 7/1989 Vorderer ..... 36/38
4,878,300 A 11/1989 Bogaty
4,881,329 A * 11/1989 Crowley ..... 36/38

(Continued)

FOREIGN PATENT DOCUMENTS

JP 01-274705 11/1989

(Continued)

*Primary Examiner*—Ted Kavanaugh
(74) *Attorney, Agent, or Firm*—Michael E. Zall

(57) ABSTRACT

A shock absorbing device for a shoe sole according to the present invention comprises: an outer sole 2; a midsole M that is disposed above the outer sole 2; and a deformation element 3 disposed between the outer sole 2 and the midsole M. The deformation element 3 is joined to the bottom surface of the midsole M and is joined to the upper surface of the outer sole 2. The deformation element has a tubular part 30 in a flat tubular form, and Young's modulus of a material constituting the tubular part 30 is greater than both that of a material constituting the midsole M and that of a material constituting the outer sole 2. The tubular part has a lower portion that is curved so as to be convex downwards and thereby undergoes bending deformation due to a shock at landing.

21 Claims, 20 Drawing Sheets

U.S. PATENT DOCUMENTS

| | | | | |
|---|---|---|---|---|
| 4,908,962 | A | 3/1990 | Yung-Mao | |
| 4,910,884 | A * | 3/1990 | Lindh et al. | 36/28 |
| 5,138,776 | A * | 8/1992 | Levin | 36/38 |
| 5,343,639 | A * | 9/1994 | Kilgore et al. | 36/29 |
| 5,572,804 | A | 11/1996 | Skaja | |
| 5,926,974 | A | 7/1999 | Friton | |
| 5,976,451 | A | 11/1999 | Skaja | |
| 5,983,529 | A | 11/1999 | Serna | |
| 6,018,889 | A | 2/2000 | Friton | |
| D433,216 | S | 11/2000 | Avar | |
| 6,226,896 | B1 | 5/2001 | Friton | |
| D444,619 | S | 7/2001 | Marvin et al. | |
| D446,003 | S | 8/2001 | Smith | |
| D446,387 | S | 8/2001 | McCourt | |
| D446,923 | S | 8/2001 | McCourt | |
| D447,324 | S | 9/2001 | Smith | |
| D447,330 | S | 9/2001 | McCourt | |
| D448,538 | S | 9/2001 | Smith | |
| D448,543 | S | 10/2001 | Marvin | |
| D448,920 | S | 10/2001 | Montross | |
| D450,437 | S | 11/2001 | Simpson | |
| D452,060 | S | 12/2001 | Estey | |
| D462,830 | S | 9/2002 | Greene | |
| 6,457,261 | B1 | 10/2002 | Crary | |
| D465,079 | S | 11/2002 | Merceron | |
| 6,487,796 | B1 | 12/2002 | Avar et al. | |
| 6,516,540 | B2 | 2/2003 | Seydel | |
| 6,546,648 | B2 | 4/2003 | Dixon | |
| D474,332 | S | 5/2003 | Turner | |
| D474,581 | S | 5/2003 | Cooper | |
| D474,582 | S | 5/2003 | Cooper | |
| 6,568,102 | B1 | 5/2003 | Healy | |
| D475,509 | S | 6/2003 | Avar | |
| D476,474 | S | 7/2003 | McDowell | |
| 6,598,320 | B2 | 7/2003 | Turner | |
| D478,714 | S | 8/2003 | Recchi | |
| D483,936 | S | 12/2003 | Fullum | |
| 6,665,956 | B2 | 12/2003 | Hay | |
| D485,053 | S | 1/2004 | McDowell | |
| D485,975 | S | 2/2004 | McDowell | |
| 6,708,426 | B2 | 3/2004 | Erickson | |
| D498,914 | S | 11/2004 | Sokolowski | |
| 6,823,612 | B2 | 11/2004 | Manz | |
| D499,248 | S | 12/2004 | Sokowlski | |
| D500,402 | S | 1/2005 | Sokolowski | |
| 6,949,642 | B2 | 9/2005 | Gao | |
| 7,314,125 | B2 * | 1/2008 | Smaldone et al. | 188/372 |
| 2003/0217485 | A1 | 11/2003 | Oishi | |
| 2003/0226283 | A1 | 12/2003 | Braunschweiler | |
| 2004/0049946 | A1 | 3/2004 | Lucas | |
| 2004/0068892 | A1 | 4/2004 | Wang | |
| 2004/0128860 | A1 | 7/2004 | Smaldone | |
| 2004/0168352 | A1 | 9/2004 | Lucas | |
| 2004/0177530 | A1 | 9/2004 | Nishiwaki | |
| 2004/0181969 | A1 | 9/2004 | Smaldone | |
| 2004/0261292 | A1 | 12/2004 | Aveni | |
| 2004/0261297 | A1 | 12/2004 | Park | |
| 2005/0268488 | A1 * | 12/2005 | Hann | 36/27 |
| 2006/0137228 | A1 | 6/2006 | Kubo | |

FOREIGN PATENT DOCUMENTS

| | | |
|---|---|---|
| JP | 02-114905 | 4/1990 |
| JP | 10-066604 | 3/1998 |
| JP | 3053446 | 10/1998 |
| JP | 11-506027 | 6/1999 |
| JP | 3082722 | 12/2001 |
| JP | 3093214 | 4/2003 |
| JP | 2004-065978 | 3/2004 |
| WO | WO 96/38062 | 12/1996 |
| WO | WO 2005/037002 | 4/2005 |
| WO | WO 2005/120272 A3 | 12/2005 |

* cited by examiner

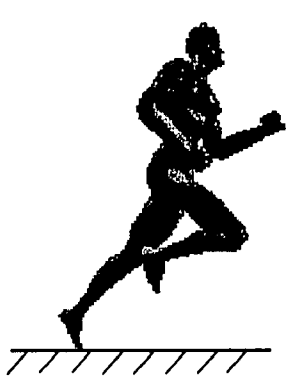
FIG. 11(a)
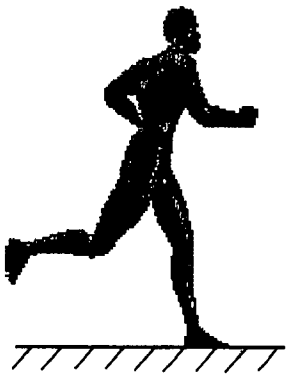
FIG. 11(b)
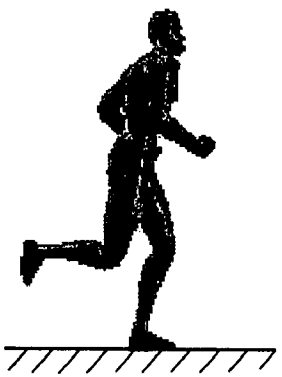
FIG. 11(c)
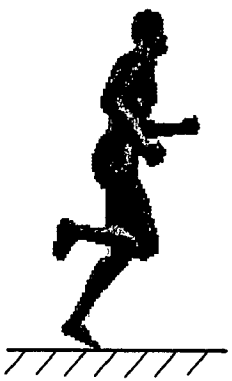
FIG. 11(d)
FIG. 11(e)

230
31
32
35
32
M
31
130
2

230
2B
31
130
33

233
230
31
130

31
230
130

230
130
2

SHOCK ABSORBING DEVICE FOR SHOE SOLE

TECHNICAL FIELD

The present invention relates to a shock absorbing device of a shoe sole.

BACKGROUND ART

The cushioning function of absorbing and alleviating the shock at landing is demanded in shoe soles, in addition to the lightness in weight and the function of supporting the foot stably. Recently, shoe soles having the repulsion function (rebound function) in addition to the above-mentioned functions have been presented. The repulsion function refers to the function of storing the impact energy at landing as deformation energy and emitting the energy of deformation when disengaging from the ground. This function is useful for improving exercise ability of a wearer.

By compressing or bending an element of the shoe sole, the deformation energy is stored in the element. However, when viscoelastic material having a small Young's modulus such as foamed resin used for a cushioning member of the shoe sole is deformed, energy is dissipated as heat and so on. Accordingly, generally, such viscoelastic material cannot perform the repulsion function sufficiently.

The configurations of shoes having the above-mentioned repulsion function are disclosed in the following patent documents.

First patent document: Japanese Utility Model Registration No. 3082722

Second patent document: Japanese Utility Model Registration No. 3053446

Third patent document: Japanese Patent Laid Open No. 02-114905

Fourth patent document: Japanese Patent Laid Open No. 01-274705

Fifth patent document: Japanese Patent Laid Open No. 2004-065978

Sixth patent document: Japanese Utility Model Registration No. 3093214

Seventh patent document: WO96/38062 (Japanese National Phase PCT Laid Open Publication of No. 11-506027)

The first and second patent documents disclose shoes with an improved repulsion function. In the first and second patent documents, the repulsion function is improved by attaching a repulsive member, which is obtained by forming an elastic material in the shape of a tube, to a bottom surface of the shoe sole. However, since such repulsive members have substantially the same size as the foot and supports the whole of the foot with a curved surface, it cannot support the foot stably.

FIG. 14(*a*) is a side view of a shoe disclosed in the third patent document. As shown in this figure, a spring 101 of generally oval cross-section is attached to a midsole 100 at a heel part of the shoe.

However, this spring 101 is accommodated in the soft midsole 100. Accordingly, most part of impact energy (shock energy) at landing is absorbed and dissipated in the midsole 100, and the remainder of the energy is absorbed by the spring 101. Accordingly, the amount of energy stored by the spring 101 is reduced.

In addition, impact load (shock force) of landing is applied to the oval spring 101 after having been dispersed in the midsole 100. Accordingly, since the dispersed impact load is applied on each part of the oval spring 101 as distributed load, the amount of deflection of the endless spring 101 is considered to be small. Therefore, impact energy cannot be stored in the oval spring 101 sufficiently.

FIG. 14(*b*) is a side view showing a partially notched shoe disclosed in the fourth patent document. As shown in this figure, a cavity 103 is formed in the shoe sole. A reaction plate 104 is built in this cavity 103. The reaction plate 104 has upper and lower facing sides 104*a*, 104*a* and fore and rear curved parts 104*b*, 104*b* that connect the upper and lower facing sides 104*a*, 104*a*. A gel cushioning member 105 is provided in the reaction plate 104.

Since the reaction plate 104 is accommodated in the shoe sole also in the shoe disclosed in this patent document, the shoe has similar demerits to the shoe of the third patent document. It is supposed that the part, in which deformation energy due to shock at landing is stored, is mainly the fore and rear curved parts 104*b*, 104*b*, not the upper and lower facing sides 104*a*, 104*a*.

FIG. 15(*a*) is a side view showing configuration of a shoe sole disclosed in the fifth patent document, and FIGS. 15(*b*) and 15(*c*) are enlarged perspective views of a deforming member thereof.

The shoe sole of the fifth patent document has a plurality of honeycomb deforming members 106. When the shoe sole is compressed vertically, the deforming members 106 deform from the state shown in FIG. 15(*b*) to the state shown in FIG. 15(*c*). At this time, a tension member 107 of the deforming member 106 is stretched, thereby to store energy therein. However, the energy stored in the member due to stretching is much smaller than the energy stored in the member due to bending. Therefore, this shoe sole also cannot store energy sufficiently.

FIG. 16(*a*) is a side view of a shoe disclosed in the sixth patent document.

In this figure, a depressed part 121 is formed at a part of the midsole 120 corresponding to the heel, and a cushioning member 121 made of plastic is disposed to the depressed part 121. The cushioning member 122 is formed to be tubular in the shape of a letter "D" from the side view. A circular-arc arch part 123 and a flat bottom plate part 124 integrally constitute the cushion member 122. A venting cavity 125 is formed between the arch part 123 and the flat plate part 124.

In this shoe, the bottom plate part 124 of the cushion member 122 is flat-shaped. Accordingly, even if the shock at landing is applied to the shoe sole from below, the bottom plate part 124 does not perform bending deformation.

FIG. 16(*b*) is a sectional view of a shoe sole disclosed in the seventh patent document.

As shown in the figure, a cavity 131 is formed in an insole body 130. A plate 132 and an insert 133 are accommodated in the cavity 131. The insert 133 has a V-shaped part consisting of a heel lever 134, a fulcrum 135 and a base 136. During heel strike, localized shock force is applied to a heel region 137, thereby to enhance the energy return characteristics of the insert 133.

In this prior art, since the heel region 137 corresponding to the V-shaped part of the insert 133 protrudes downwards, shock force is easy to be absorbed by the insert 133.

However, since the insert 133 is V-shaped, when a load F1 is applied obliquely from below the shoe at an initial landing of the foot, the base 136 is easy to be compressed in the longitudinal direction of the plate and to buckle. Accordingly, in the case where the load F1 is applied obliquely from below the shoe, the base 136 is hard to perform bending deformation. Further, bending deformation does not occur in a part of the heel lever 134 forward of the fulcrum 135. That is, the part of the heel lever 134 cannot absorb shock or store energy.

Moreover, with the configuration shown in this figure, in the foot-flat stance where the whole of the foot touches the ground, the insert 133 bends, thereby to return stored energy. However, in the period during which the initial landing is shifted to the foot-flat stance, energy cannot be stored sufficiently and therefore cannot be returned sufficiently.

DISCLOSURE OF THE INVENTION

Therefore, an object of the present invention is to provide a shock absorbing device for a shoe sole performing a high cushioning function and repulsion function by absorbing and storing the impact load of landing sufficiently.

A shock absorbing device for a shoe sole according to the present invention comprises: an outer sole having a ground contact surface that contacts the ground at landing and an upper surface opposite to the ground contact surface; a midsole that is disposed above the outer sole and has a bottom surface; and a deformation element disposed between the outer sole and the midsole. The deformation element is joined to the bottom surface of the midsole and is joined to the upper surface of the outer sole. The deformation element has a tubular part in a flat tubular form. Young's modulus of a material constituting the tubular part is greater than both that of a material constituting the midsole and that of a material constituting the outer sole. The tubular part is arranged so as to have a major axis generally along a longitudinal direction of a foot and a minor axis generally along a vertical direction. A length of the major axis is set within a range of about 25 mm to about 80 mm. The tubular part has a lower portion that is curved so as to be convex downwards and thereby undergoes bending deformation due to an impact load of landing. A concave first curved surface is provided on the upper surface of the outer sole, and the lower portion of the tubular part fits into the first curved surface of the outer sole.

In a shock absorbing device for a shoe sole according to the present invention, an external force applied to the outer sole is directly transmitted to the tubular part having a great Young's modulus before being absorbed by the soft midsole. Accordingly, since the tubular part can absorb much of the external force, the tubular part performs a high repulsion function by leaf spring (flat spring) structure. In addition, the tubular part, the outer sole and the midsole integrally deforms, thereby to perform a high cushioning function.

Especially, since the lower portion of the tubular part is curved so as to be convex downwards, the lower portion performs large bending deformation due to the impact load of landing. Accordingly, the lower portion can easily store repulsion energy and perform a high cushioning function.

Furthermore, since the length of the major axis (major diameter) of the tubular part is set within a range of about 25 mm to about 80 mm, the tubular part is expected to perform sufficient bending deformation, and is able to support the foot stably. That is, when the length of the major axis of the tubular part is less than 25 mm, the tubular part is too small to perform bending deformation; when the length of the major axis is more than 80 mm, the tubular part is too large to maintain the stability. In view of this, it is preferred that the length of the major axis of the tubular part be set within a range of about 35 mm to 55 mm.

In the present invention, by the use of the term "the deformation element is joined to the bottom surface of the midsole", it is meant to include, for example, the case where the deformation element is joined directly to the midsole and the case where the deformation element is indirectly joined to the midsole via another member, which is located between the deformation element and the midsole and retains the deformation element.

By the use of the term "the deformation element is joined to the upper surface of the outer sole", it is meant to include the case where a bottom surface of the deformation element is joined directly to the upper surface of the outer sole, and the case where another member to improve the adhesiveness between the deformation element and the outer sole is interposed therebetween.

According to a preferred aspect of the present invention, the tubular part has an upper portion that is curved so as to be convex upwards and thereby undergoes bending deformation due to the impact load of landing, a concave second curved surface is provided on the bottom surface of the midsole, and the upper portion of the tubular part fits into the second curved surface of the midsole.

In this aspect, since the upper portion of the tubular part is curved, both ends of the upper portion can be displaced in the direction of the major axis. Accordingly, the lower portion of the tubular part becomes easier to deform. In addition, the upper portion of the tubular part also becomes easier to perform bending deformation. Accordingly, the function of absorbing and storing the impact energy at landing on the ground becomes higher.

According to another preferred aspect of the present invention, a third curved surface that is curved so as to be convex downwards generally along the lower portion of the tubular part is provided on the ground contact surface of the outer sole.

In this aspect, since the ground contact surface is curved, the bending deformation of the lower portion is immediately caused due to the shock applied to a part of the ground contact surface of the outer sole at the moment of landing, i.e., at the time of the first strike. Accordingly, the impact energy of landing can be absorbed and stored in approximately the whole of the lower portion of the tubular part. In addition, since the curved outer sole deforms at the same time, the outer sole can also absorb and store the impact energy.

Since the outer sole is curved, the outer sole need not be formed unnecessarily thick, thereby to decrease the weight of the shoe sole. Furthermore, the outer sole becomes of such a shape that the outer sole may land sequentially from its rear end to its front while a wearer takes the landing action, i.e., a heel part of the foot lands and then the fore foot part gradually lands on the ground. Accordingly, a smooth motion of the foot during the period from landing on the ground to disengaging from the ground can be realized.

According to another preferred aspect of the present invention, the tubular part is disposed at a rear foot part of the midsole, and at least a part of the lower portion of the tubular part protrudes (bulges) downwards further than the rear foot part of the midsole.

In this aspect, since the lower portion of the tubular part protrudes downwards, the part of the outer sole below the tubular part firstly lands on the ground in the above-mentioned landing action. Accordingly, a great impact load at the moment of the landing (at the time of the first strike) is absorbed and stored in the deformation element. In view of this, it is preferred that substantially whole of the lower portion of the tubular part protrude (bulge) downwards further than the rear foot part of the midsole.

According to another preferred aspect of the present invention, the deformation element is provided at least on a lateral side of a rear foot part of the foot.

Generally, at landing, the lateral side of the rear foot part of the foot firstly lands on the ground, and therefore, by providing the deformation element on the lateral side of the rear foot part of the foot, the impact load of landing can be more sufficiently absorbed.

In this aspect, it is preferred that at least two deformation elements be provided separately from each other in a medial-lateral direction of the foot. Such constitution is useful for weight saving of the shoe.

In the case where deformation elements at the rear foot part of the foot are provided separately from each other in the medial-lateral direction (widthwise direction) of the foot, it is preferred the rigidity of the deformation element on the medial side be set greater than that of the deformation element on the lateral side, for example, by making their Young's modulus or thickness different from each other.

In addition, it is more preferred that at least two deformation elements be provided on the lateral side of the rear foot part of the foot. In such constitution, deformation elements of appropriate size can be arranged on the lateral side of the foot, thereby to absorb the shock and perform the high repulsion function in substantially the whole of the lateral side of the rear foot part where the shock of landing is applied.

In the case where deformation elements are provided separately from each other in the medial-lateral direction of the foot, it is preferred the minor axis of the tubular part becomes shorter as it gets closer to a center in the medial-lateral direction of the foot. The major axis may be of the similar shape.

In such constitution, since the diameter of the tubular part varies, it becomes possible to remove a mold or a die at the time of molding the tubular part. Furthermore, by forming the minor axis of the tubular part in the center in the medial-lateral direction shorter than that in the medial edge and lateral edge, it is possible to prevent the center of the shoe sole from protruding further than the medial side and the lateral side of the shoe sole, thereby to improve the stability of the foot in a stationary state.

According to another preferred aspect of the present invention, a shock absorbing member having a smaller Young's modulus than the tubular part is provided in an internal space of the tubular part.

If the shock is absorbed only in the tubular part, too much localized stress may be induced in a part of the tubular part. Accordingly, by providing the cushioning member other than the tubular part in the internal space of the tubular part, a burden to the tubular part can be reduced.

In addition, by providing the cushioning member having a smaller Young's than the tubular part in the internal space of the tubular part, it becomes possible to apply various combination of the tubular part having the repulsion function and the cushioning member having the cushioning function. It enables more appropriate design of the deformation element, taking into consideration the characteristics of repulsion, cushioning, endurance and so on.

In the present invention, it is preferred that the Young's modulus of the material constituting the tubular part be set within a range of about 1 kgf/mm$^2$ to about 30 kgf/mm$^2$.

This is because when the Young's modulus of the material constituting the tubular part is less than 1 kgf/mm$^2$, the material is so soft that the energy cannot be stored in the curved lower portion of the tubular part; when the Young's modulus of the material constituting the tubular part is more than 30 kgf/mm$^2$, the rigidity of the lower portion is so large that deflection of the lower portion is too small and that the lower portion cannot store the energy sufficiently.

According to another preferred aspect of the present invention, the tubular part has a front end portion in front of the lower portion and a rear end portion in the rear of the lower portion, and external surfaces of the two end portions are covered with the midsole and/or the outer sole.

Every time the lower portion of the tubular part undergoes bending deformation, a great stress is induced at the end portions of the tubular part. Accordingly, the end portions need great endurance. By covering such end portions with the midsole and/or the outer sole, aging deterioration of the end portions by light or the like can be prevented, thereby to improve the endurance of the end portions.

According to another preferred aspect of the present invention, the tubular part has a front end portion in front of the lower portion and a rear end portion in the rear of the lower portion, and a thickness of the end portion is greater than both that of the upper portion and that of the lower portion. By thickening the two end portions, which are subjected to great load due to the bending deformation, it becomes possible to improve more the endurance of the end portions.

In this aspect, for example, the thickness of the end portions is set within a range of about 1.5 mm to about 8.0 mm, and the thickness of the upper portion and the thickness of the lower portion are each set within a range of about 1.0 mm to about 4.0 mm.

According to another preferred aspect of the present invention, a connecting member having a greater Young's modulus than the midsole is joined to the bottom surface of the midsole, the tubular part is joined to the connecting member, and by joining the tubular part to the connecting member, the deformation element is retained by the connecting member.

Thus, by locating the connecting member above the deformation element, which member has a greater Young's modulus, and joining the deformation element to this connecting member, the adhesiveness of the deformation element is improved. That is, the deformation element becomes less likely to drop off. Furthermore, since the connecting member having a greater Young's modulus retains the deformation element, the deformation element becomes less likely to be displaced.

According to another preferred aspect of the present invention, the tubular part is integrally formed to be a single seamless member which is seamless in a longitudinal section of the shoe sole.

According to another preferred aspect of the present invention, a length of the minor axis of the tubular part is set within a range of about 8 mm to about 25 mm, and flatness obtained by dividing the length of the major axis by the length of the minor axis of the tubular part is set within a range of about 1.5 to about 4.0.

If the length of the minor axis of the tubular part is less than about 8 mm, the lower portion cannot have sufficiently large curvature, and so cannot absorb the shock sufficiently by bending deformation. If the minor diameter is more than 25 mm, too large deformation is caused, and so the foot cannot be supported stably, i.e., the stability of the foot is impaired.

BRIEF DESCRIPTION OF THE DRAWINGS

FIGS. 11(*a*) to 11(*e*) are schematic side views showing behavior of a body from landing on the ground to disengaging from the ground during running.

DESCRIPTION OF REFERENCE NUMERALS

Figure 1:
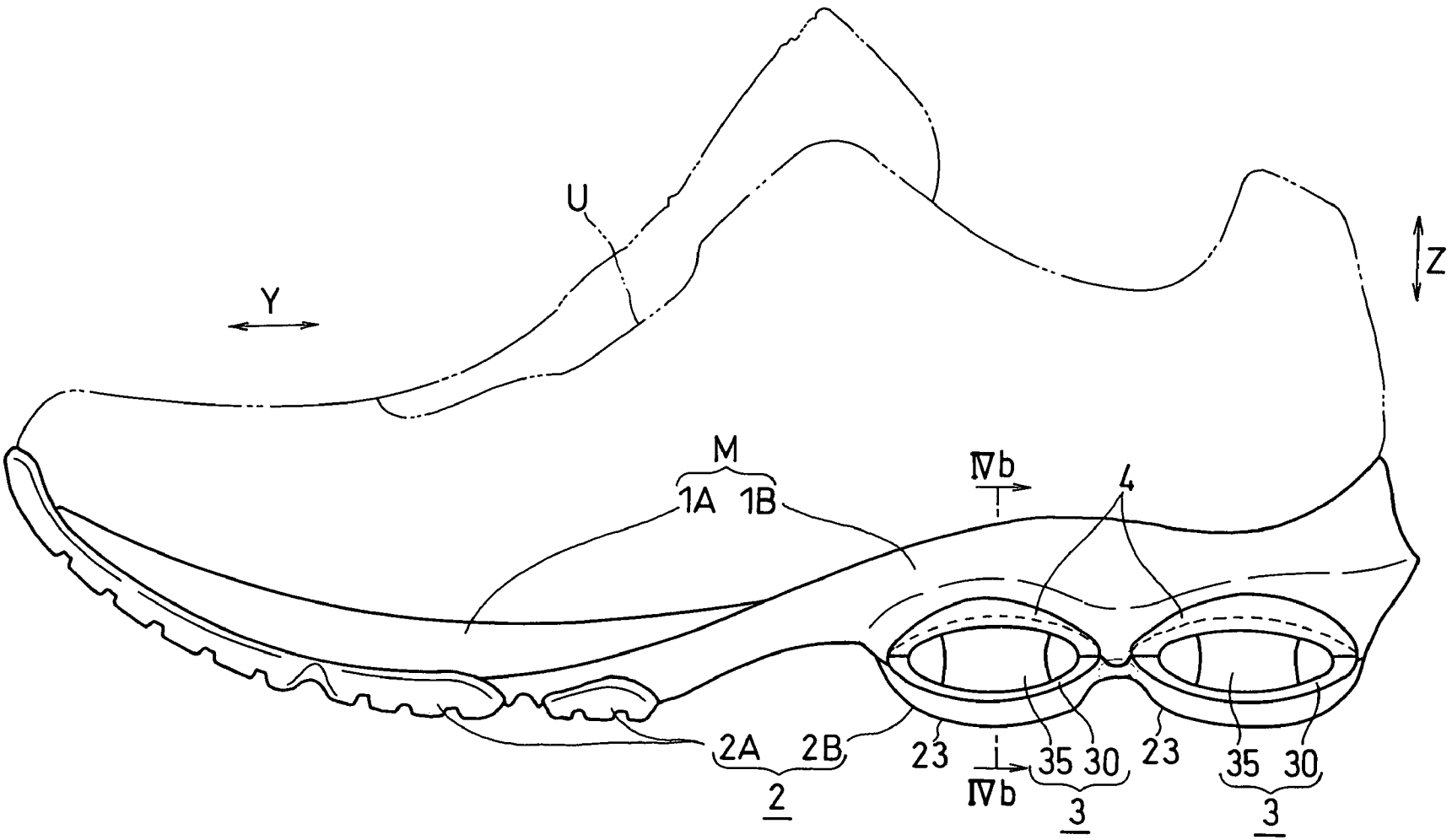
FIG. 1 is a lateral side view of a shoe according to a first embodiment of the present invention.

12: Second curved surface
2, 2A, 2B: Outer sole
21: First curved surface
23: Third curved surface
3: Deformation element
30, 130, 230, 330, 430: Tubular part
31: Lower portion
32: Upper portion
33: End portion
35: Cushioning member
4: Connecting member
Lr: Major axis
Sr: Minor axis
M: Midsole
X: Medial-lateral direction
Y: Longitudinal direction
Z: Vertical direction

BEST MODE FOR CARRYING OUT THE INVENTION

The present invention will be understood more apparently from the following description of preferred embodiment when taken in conjunction with the accompanying drawings. However, it will be appreciated that the embodiments and the drawings are given for the purpose of mere illustration and explanation and should not be utilized to define the scope of the present invention. The scope of the present invention is to be defined only by the appended claims. In the drawings annexed, the same reference numerals denote the same or corresponding parts throughout several views.

Embodiments of the present invention will now be described with reference to the drawings.

First Embodiment

FIGS. 1 to 4 show a first embodiment of the present invention.

As shown in FIG. 1, a shoe sole of this embodiment includes a midsole (an example of supporting element) M, an outer sole 2 and deformation elements 3. The midsole M is formed by vertically bonding a first midsole body 1A which is arranged in an upside and a second midsole body 1B which is arranged in a downside. The outer sole 2, a so-called shank (not shown) etc. are disposed on bottom surfaces of the midsole bodies 1A, 1B. An insole (not shown) is bonded onto the first midsole body 1A. Each midsole body 1A, 1B is, for example, formed of a material suitable for shock absorption, i.e. a midsole material such as resin foam of EVA (ethylene-vinyl acetate copolymer), polyurethane or the like. Above the midsole M and the insole, an upper U that is suitable for covering the instep of the foot is disposed. The outer sole 2 that gets contact with the ground surface or the floor surface at the time of landing is formed of a material having a higher abrasion resistance than the midsole material, i.e. an outer sole material.

Figure 2:
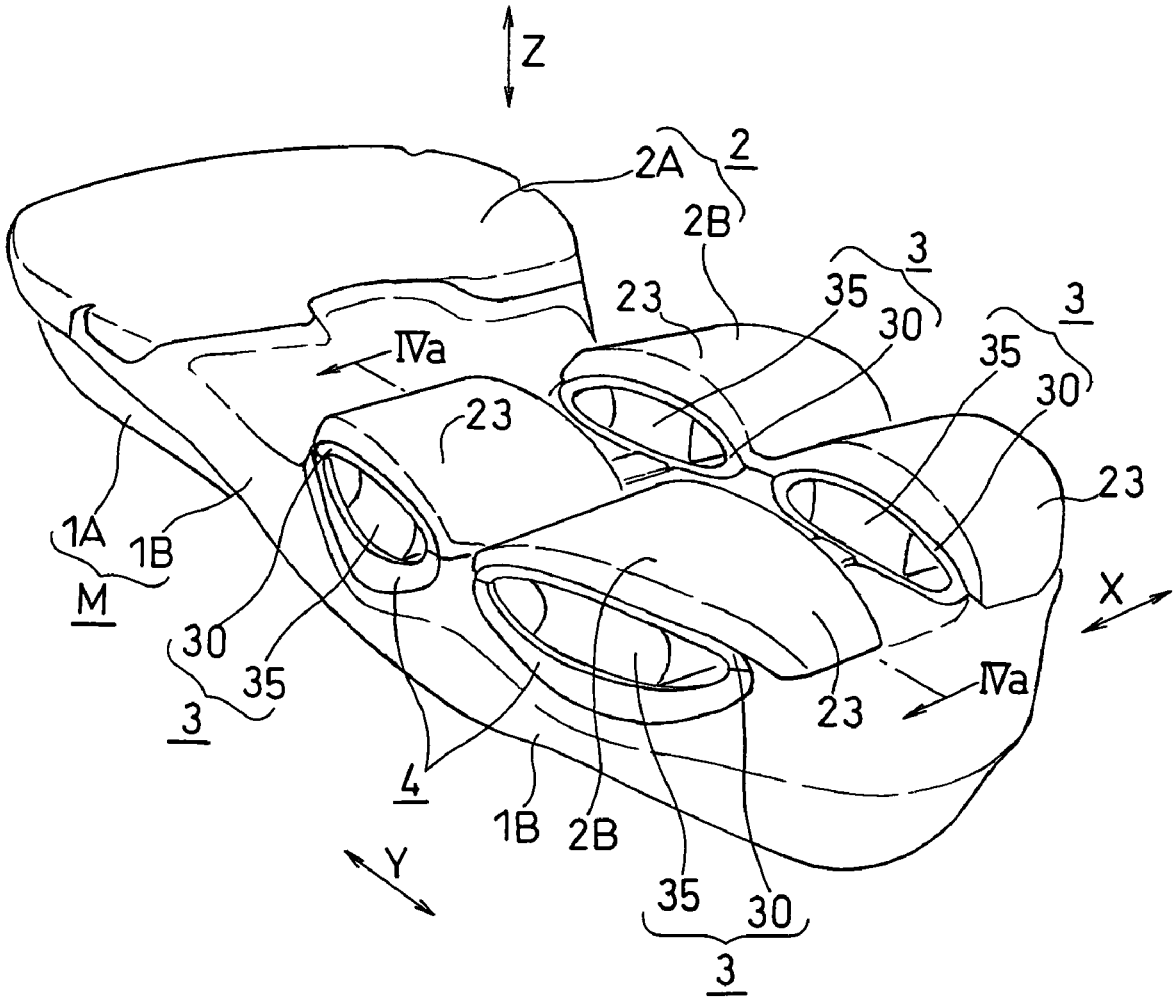
FIG. 2 is a perspective view of the same shoe viewed from a bottom surface side of the shoe sole.

FIG. 2 is a perspective view of the shoe sole of the present embodiment, viewed from its bottom surface side.

As shown in FIG. 2, the outer sole 2 includes a first outer sole 2A provided at a fore foot part of the foot and the second outer sole 2B provided at a rear foot part of the foot. Deformation elements 3 and a connecting member 4 for retaining the deformation elements 3 are interposed between the second outer sole 2B and the second midsole body 1B.

As shown in FIG. 2, four deformation elements 3 are provided in the shoe sole; two of them are disposed on a medial side of the rear foot part of the foot, and the remaining two of them are disposed on a lateral side of the rear foot part of the foot. That is, the deformation elements 3 are arranged in two rows located on the medial and lateral side of the rear foot part, with two deformation elements disposed in each row. The deformation elements 3 on the medial side of the rear foot part and the deformation elements 3 on the lateral side of the rear foot part are spaced apart from each other in the medial-lateral direction X of the foot. The two deformation elements 3 on the medial side of the rear foot part are spaced apart form each other in the longitudinal direction Y, and so are the two deformation elements 3 on the lateral side of the rear foot part.

The second outer sole 2B are divided into the medial side and the lateral side, and the medial and lateral sides of the second outer soles 2B are spaced apart from each other in the medial-lateral direction. Each side of the second outer soles 2B is arranged so as to cover, from below, the two deformation elements 3, 3 aligned along the longitudinal direction Y on the respective side.

Figure 3:
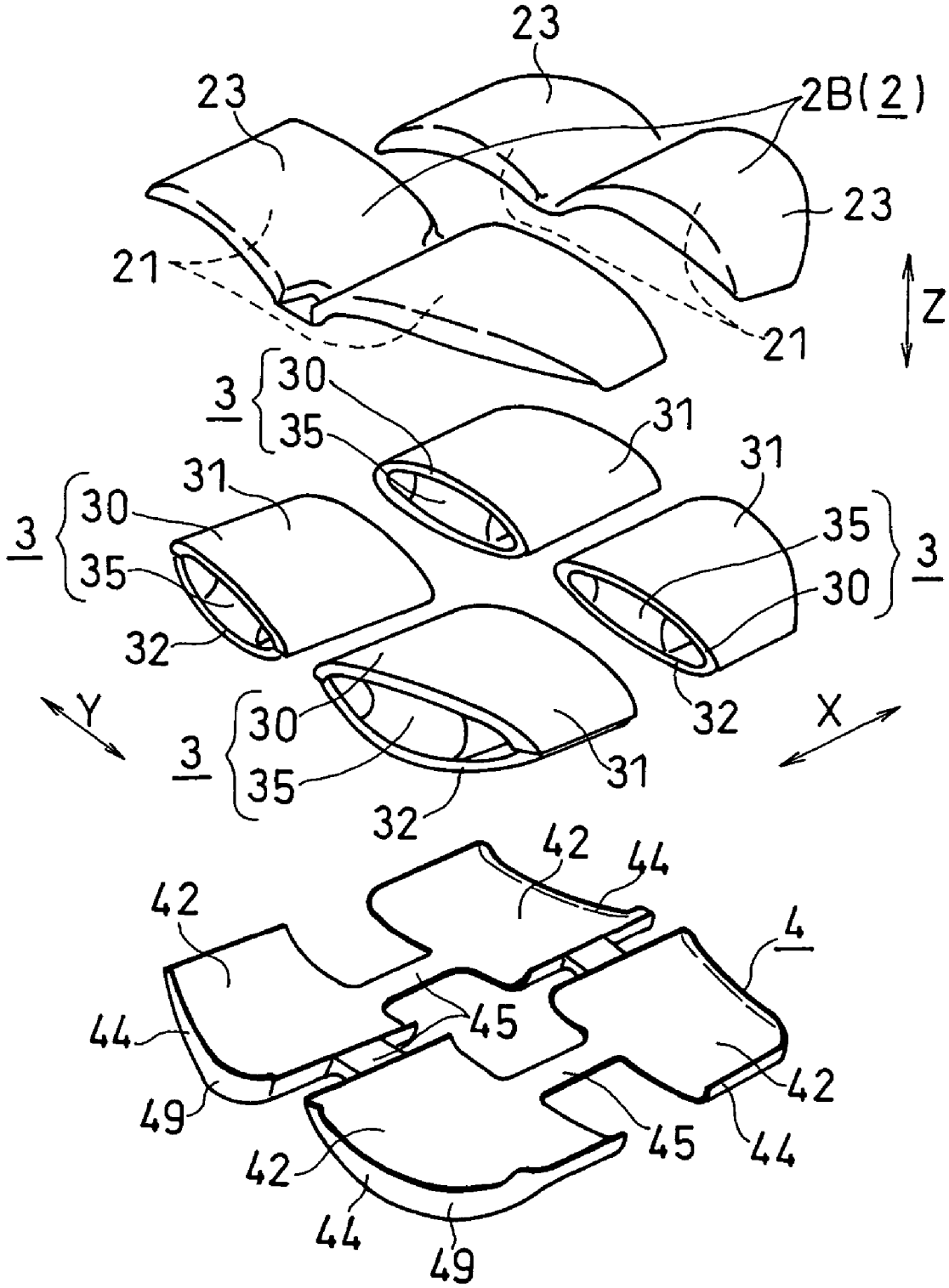
FIG. 3 is an exploded perspective view of an outer sole, a deformation element and a connecting member viewed from the bottom surface side.

FIG. 3 is a exploded perspective view of the second outer sole 2B, the deformation elements 3 and the connecting member 4 of FIG. 2, viewed from the bottom surface side.

As shown in FIG. 3, the upper surface of the second outer sole 2B is adhesive bonded to a lower portion 31 of the deformation element 3 (upper half of the deformation element 3 in FIG. 3). The upper portion 32 of the deformation element 3 (lower half of the deformation element 3 in FIG. 3) is adhesive bonded or fusion bonded to the connecting member 4, and the connecting member 4 is adhesive bonded to the bottom surface of the second midsole body 1B (FIG. 2). That is, the upper portion 32 of the deformation element 3 is joined to the bottom surface of the second midsole body 1B via the connecting member 4.

Deformation Element 3:

As shown in FIG. 3, the deformation element 3 includes a tubular part (tubular member) 30 and a cushioning member 35. Each tubular part 30 has an opening 30 passing through the tubular part 30 from one end to the other end along the widthwise direction and has a internal space therein. This tubular part 30 may have a generally oval sectional shape in the longitudinal sectional view of the shoe sole. The cushioning member 35 is provided in the internal space of the tubular part 30. In this embodiment, the cushioning member 35 is provided so as to be in contact with the upper portion 32 and the lower portion 31 generally at the longitudinal center of the internal space, i.e., so as to be mating contact with tubular walls of the tubular part 30.

Young's modulus of the cushioning member 35 is smaller than that of the tubular part 30. A material forming the cushioning member 35 may be, for example, a rubber-like or pod-like compression deformation member.

The "rubber-like or pod-like compression deformation member" means a member that deforms so as to store a force of restitution (repulsion) while being compressed, and includes not only a member having rubber elasticity such as thermoplastic elastomer and vulcanized rubber but also a pod-like or bladder-like member in which air, a gelatinous material, a soft rubber-like elastic material or the like is filled. The "thermoplastic elastomer" means a polymer material that exhibits a property of vulcanized rubber at normal temperature and gets plasticized at high temperature to be molded with a plastic processing machine.

In the present invention, the rubber-like member, i.e., the member having rubber elasticity, means a member that is capable of great deformation (for example, rupture elongation thereof is more than 100%) and that is capable of recovering its original shape after the stress σ (sigma) is removed. In this member, as shown in a solid line L1 of the stress-strain diagram of FIG. 20, generally, as the strain δ (delta) gets greater, the amount of change of the stress σ with respect to the amount of change of the strain δ becomes larger.

Figure 20:
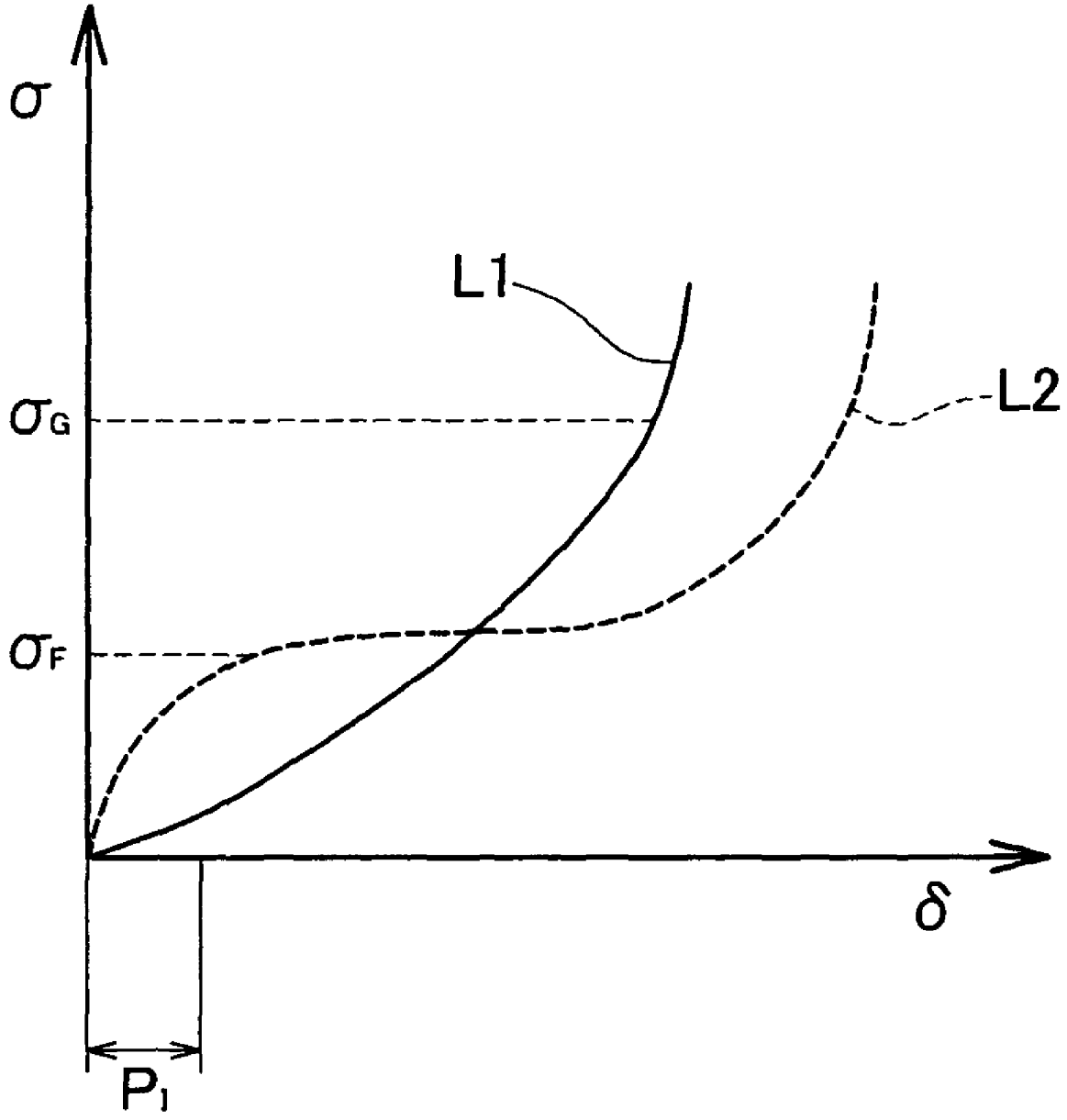
FIG. 20 is a stress-strain diagram.

Accordingly, generally, as shown in a broken line L2 of the FIG. 20, a material in which, when a stress σ is above a certain extent, the strain δ increases with little increase of the stress σ (for example, resin foam) is not the member having the rubber elasticity.

As shown in FIG. 20, an elastic limit $\sigma_F$ of such resin form is smaller than an elastic limit $\sigma_G$ of the rubber-like member. Accordingly, such resin foam might cause unstable support of the foot when a localized load is applied.

Note that the "elastic limit" means a maximum stress in the range where the relationship between the change of the compression load applied to the compression deformation member and the change of the amount of the compression of this member is proportional, i.e., where the change of the strain is proportional to the change of the compression stress.

In the present invention, "Young's modulus" means a ratio of the stress to the strain in the beginning $P_I$ of the deformation of the material, as shown in FIG. 20.

The rubber-like member may be formed of rubber or rubber-like synthetic resin (thermoplastic elastomer). In the case where the rubber-like member is formed of rubber-like synthetic resin, for example, gel (commercial name for the cushioning member), a material of the rubber-like member may be, for example, polyurethane gel or styrene gel. The rubber-like member may be formed of resin form of EVA etc., instead of the gel or in addition to the gel.

Instead of the rubber-like member, a member that deforms so as to store a force of restitution (repulsion) while being compressed, such as a pod-like member in which air or liquid is filled, may be used.

Since load is concentrated on the deformation element 3, great stress is generated therein. Therefore, it is preferred that the elastic limit of the cushioning member 35 is larger than that of the midsole M. It makes the cushioning member 35 less likely to be subjected to permanent deformation even if the shoe is worn over and over again.

In a case where a material forming the cushioning member 35 is gel, it is preferred that Young's modulus of the gel is about 0.1 kgf/mm$^2$ to about 1.0 kgf/mm$^2$.

The tubular part 30 is formed of a material having Young's modulus greater than Young's modulus of the material forming the midsole M and Young's modulus of the material forming the outer sole 2. The Young's modulus of the material forming the tubular part 30 is about 1.0 kgf/mm$^2$ to about 30 kgf/mm$^2$, and, more preferably, it is about 2.0 kgf/mm$^2$ to about 10 kgf/mm$^2$. The material forming the tubular part 30 may be, for example, non-foam resin such as nylon, polyurethane and FRP.

Young's modulus of the materials forming the tubular part 30 and the cushioning member 35 may differ from the medial side of the rear foot part to the lateral side of the rear foot part. A thickness of the tubular part 30 and a section area of plane section of the cushioning member 35 may differ from the medial side of the rear foot part to the lateral side of the rear foot part. Such setting makes a vertical compressive stiffness per unit area of the deformation element 3 on the lateral side of the rear foot part less than that of the deformation element 3 on the medial side of the rear foot part, thereby preventing an excessive pronation of the foot.

Figure 4A:
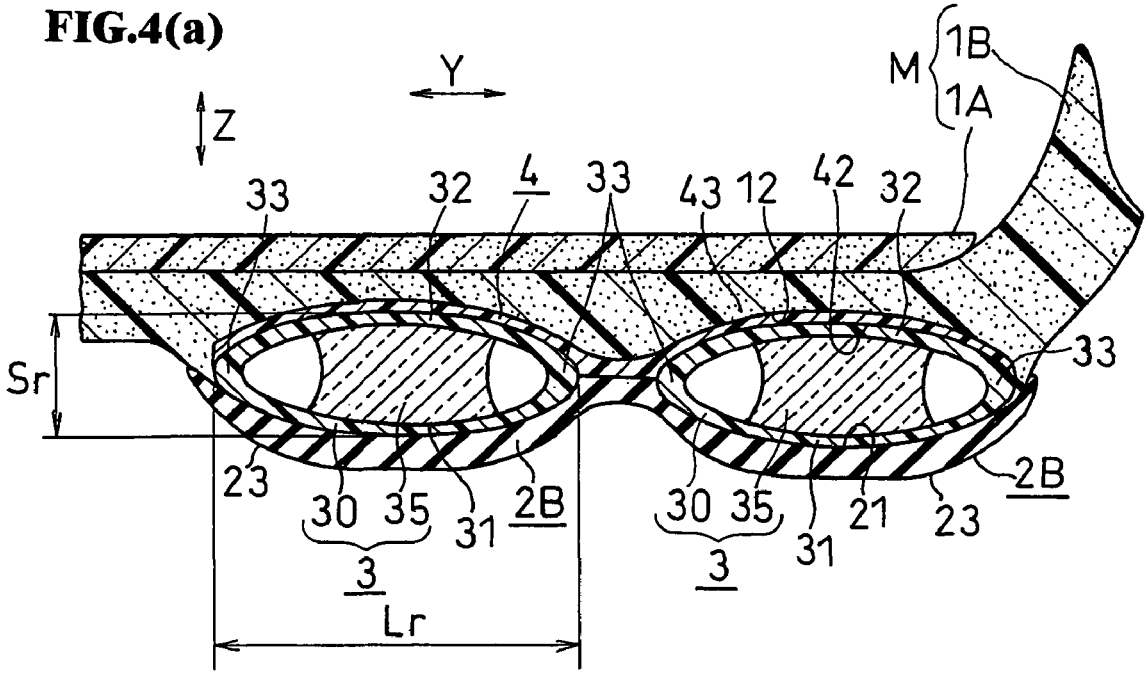
FIG. 4(*a*) is a view obtained by rotating by 180 degrees a sectional view taken along the line IVa-IVa of FIG. 2 and FIG. 4(*b*) is a sectional view taken along the line IVb-IVb of FIG. 1.
Figure 4B:
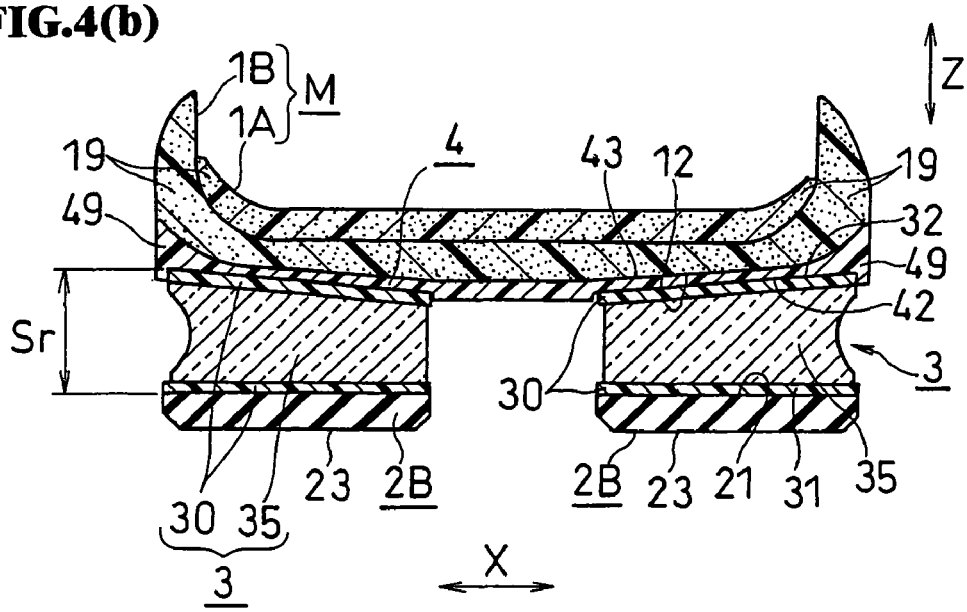

FIG. 4(*a*) is a longitudinal sectional view of the shoe sole which view is obtained by rotating by 180 degrees a sectional view taken along the line IVa-IVa of FIG. 2 so that the shoe sole is illustrated in accordance with usual top and bottom orientation. FIG. 4(*b*) is a transverse sectional view taken along the line IVb-IVb of FIG. 1.

As shown in FIG. 4(*a*), the tubular part 30 is integrally formed to be seamless in the longitudinal section of the shoe sole. The tubular part 30 is flattened to be of substantially oval or elliptical shape having a major axis Lr generally along the longitudinal direction Y of the foot and a minor axis Sr generally along the vertical direction Z. That is, the tubular part 30 includes: the lower portion 31 that is curved along the longitudinal direction Y so as to be convex downwards; and the upper portion 32 that is curved along the longitudinal direction Y so as to be convex upwards. The lower portion 31 and the upper portion 32 undergo bending deformation due to impact load of landing, because of their curved shape. This deformation makes the deformation element 3 compressed in the vertical direction. The detail of the bending deformation of the lower portion 31 of the tubular part 30 due to the impact load of landing will be described later.

The length of the major axis Lr is set within a range of about 25 mm to about 80 mm. The length of the minor axis Sr is set within a range of about 8 mm to about 25 mm. Note that the length of the minor axis Sr means the height of the deformation element. Flatness (Lr/Sr) obtained by dividing the length of the major axis Lr by the length of the minor axis Sr of the tubular part is set within a range of about 1.5 to about 4.0.

As shown in FIG. 4(*b*), the minor axis Sr of the tubular part 30 becomes shorter as it gets closer to a center in the medial-lateral direction of the foot. Similarly, the major axis Lr of the tubular part 30 becomes shorter as it gets closer to the center in the medial-lateral direction of the foot.

As shown in FIG. 4(*a*), end portions (a front end portion and a rear end portion) 33 are provided, respectively, in front of and in the rear of the lower portion 31 of the tubular part 30. A thickness of each end portion 33 is greater than both that of the upper portion 32 and that of the lower portion 31. The thickness of the end portion 33 is set within a range of about 1.5 mm to about 8.0 mm, and the thickness of the lower portion 31 and the thickness of the upper portion 32 are, each, set within a range of about 1.0 mm to about 4.0 mm.

It is preferred that in the vicinity of the end portion (the front end and the rear end) of the major axis Lr, the thickness of the tubular part 30 gradually increases as it gets closer to the end portions, and the thickness of the tubular part 30 at the end portion of the major axis Lr is set approximately twice to five times as large as that at end portions (the upper end and the rear end) of the minor axis.

Because of such settings, when the impact load of landing is applied, the tubular part 30 will substantially not undergo deformation at the end portions of the major axis Lr and will undergo bending deformation at the end portions of the minor axis Sr. Moreover, since the thickness of the tubular part 30 does not change abruptly in the vicinity of the end portions of the major axis Lr, the end portions become less likely to be subjected to stress concentration, thereby greatly improving the endurance of the tubular part 30.

Connecting Member 4:

As shown in FIG. 4(*a*), a lower curved surface 42, which is concave along the upper portion 32 of the tubular part 30, is provided on a lower surface of the connecting member 4, and the upper portion 32 of the tubular part 30 fits into the lower curved surface 42. A concave second curved surface 12 is provided on the bottom surface of the second midsole body 1B. An upper curved surface 43, which is curved to be convex upwards along the second curved surface 12, is provided on an upper surface of the connecting member 4. This upper curved surface 43 of the connecting member 4 fits into the second curved surface 12 of the second midsole body 1B.

Accordingly, the upper portion 32 of the tubular part 30 fits into the second curved surface 12 of the second midsole body 1B via the connecting member 4.

As shown in FIG. 3, in this embodiment, four retaining part 44 are provided on one connecting member 4, and the retaining parts 44 are connected with each other by connection bars 45. The lower curved surface 42 into which the upper portion 32 of the tubular part 30 fits is provided on each retaining part 44. Accordingly, a plurality of tubular parts 30 can easily be joined to the second midsole body 1B (FIG. 2), by joining the plurality of tubular parts 30 to the lower curved surface 42 of each retaining part 44 of the connecting member 4 and then joining the connecting member 4 to the second midsole body 1B. Furthermore, adhesiveness of the tubular part 30 is improved by joining the upper portion 32 of the tubular part 30 to the connecting member 4. That is the tubular part 30 will be less likely to drop off from the shoe sole.

Young's modulus of the connecting member 4 is set larger than that of the midsole M. Since the connecting member 4 having such large Young's modulus retains the tubular part 30, the midsole M becomes less likely to suffer a high localized load at the time of landing and a part of the midsole M where the tubular part 30 is joined is less likely to be damaged, as compared to a case where the tubular part 30 is directly joined to the midsole M.

As shown in FIG. 4(*b*), the first and second midsole bodies 1A, 1B have a first roll-up portion 19 rolling upwards along the side face from the sole of the foot. The connecting member 4 has a second roll-up portion 49 rolling upwards outside the first roll-up portion 19. That is, the second roll-up portion 49 rolling upwards is provided on both ends of the medial-lateral direction of the connecting member 4. Since the connecting member 4 of harder material is rolling upwards outside the first roll-up portion 19 of the midsole M, the first roll-up portion 19 is sufficiently supported and therefore the foot can be stably supported.

Second Outer Sole 2B:

As shown in FIG. 4(*a*), below the tubular part 30, the second outer sole 2B is curved along the lower portion 31 of the tubular part. A concave first curved surface 21 is provided on the upper surface of the second outer sole 2B. The lower portion 31 of the tubular part 30 is fit into the first curved surface 21 without clearance. A third curved surface 23 is provided on the ground contact surface of the second outer sole 2B and the third curved surface is curved to be convex downwards along the lower portion 31 of the tubular part 30. As shown in FIG. 3, the second outer sole 2B is separated into two in the medial-lateral direction, each covering the lower portions 31, 31 of a pair of the tubular parts 30, 30 aligned along the longitudinal direction Y.

As shown in FIG. 4(*a*), the upper portion 32 of the tubular part 30 is fit into the second midsole body 1B via the connecting member 4, and substantially whole of the lower portion 31 of the tubular part 30 protrudes (bulges) downwards further than the lower end of the second midsole body 1B (the lowermost of the bottom surface of the second midsole body 1B). Substantially whole of the lower portion 31 of the tubular part 30 is covered with the second outer sole 2B. The second outer sole 2B is joined to the second midsole body 1B in the vicinity of the front and rear end portions of the connecting member 4.

In the rear foot part of the foot, an area of the bottom surface of the midsole body 1B divided by an area of the bottom surface of the second outer sole 2B is 1.3 or more. That is, an area of the bottom surface of a part of the midsole M in the rear of the arch divided by the area of the bottom surface of the second outer sole 2B is 1.3 or more.

As shown in FIG. 4(*a*), the lower portion 31 and the upper portion 32 of each tubular part 30 is connected via the front and rear end portions 33, 33, and these end portions 33 can be a center of deformation during the bending deformation of the lower portion 31 and the upper portion 32. Among these end portions 33, two end portions 33, 33 are located on a near side where the pair of the tubular parts 30, 30 face each other, the upper part of these two end portions 33, 33 is covered with the connecting member 4 and the lower part thereof is covered with the second outer sole 2B. The other end portions 33, 33 are located on a far side which is opposite to the near side, the upper part thereof is covered with the connecting member 4, and the terminal part thereof (the anterior or posterior part) is covered with the second midsole body 1B, which extends around from the upper part to the lower part of the end portion 33. In addition, the terminal part of the end portions 33 is also covered with the second outer sole 2B from the outside of the second midsole body 1B. Thus, the external surfaces of the end portions 33 of the tubular part 30 are covered with the second midsole body 1B and/or the second outer sole 2B.

Since the end portions 33 of the tubular part 30 are covered with another member, the end portions 33, which is subjected to large load every time the tubular part 30 undergoes the bending deformation, can be protected from the strength reduction due to aging deterioration of by light and the like, the endurance of the end portions.

Deformation of the shoe sole during the period from landing on the ground to disengaging from the ground:

Next, a test on deformation of the shoe sole in the case where the user, wearing the shoe sole of the first embodiment, makes a series of motions from landing on the ground to disengaging from the ground will be described. In this test, the Young's modulus of the tubular part 30 was set at 5 $kgf/mm^2$. A gel was used as the shock absorbing member, and the Young's modulus of a gel 35 on the lateral side of the foot and that of a gel 35 on the medial side of the foot were set at 0.2 $kgf/mm^2$ and 0.3 $kgf/mm^2$, respectively.

First, a motion of the foot during running will be described. FIGS. 11(*a*) to 11(*e*) are schematic side views showing a series of motions of a body from landing on the ground to disengaging from the ground during running. FIG. 11(*a*) shows the state where the foot firstly lands on the ground, i.e., the rear end of the heel gets contact with the ground (so-called "heel-contact"), FIG. 11(*b*) shows the state where substantially the whole of the sole of the foot is in contact with the ground (so-called "foot-flat"), FIG. 11(*c*) shows the state immediately before the foot starts to kick (so-called "mid-stance"), FIG. 11(*d*) shows the state where the foot kicks the ground with the heel lifted (so-called "heel-rise") and the FIG. 11(*e*) shows the state immediately before the toe disengages from the ground (so-called "toe-off"). As shown in these figures, the foot lands on the ground from the rear end of the heel, the whole of the sole gradually contacts the ground, and then, the fore foot part kicks the ground to disengage from the ground.

Figures 12A, 12B, 12C, 12D, 12E:
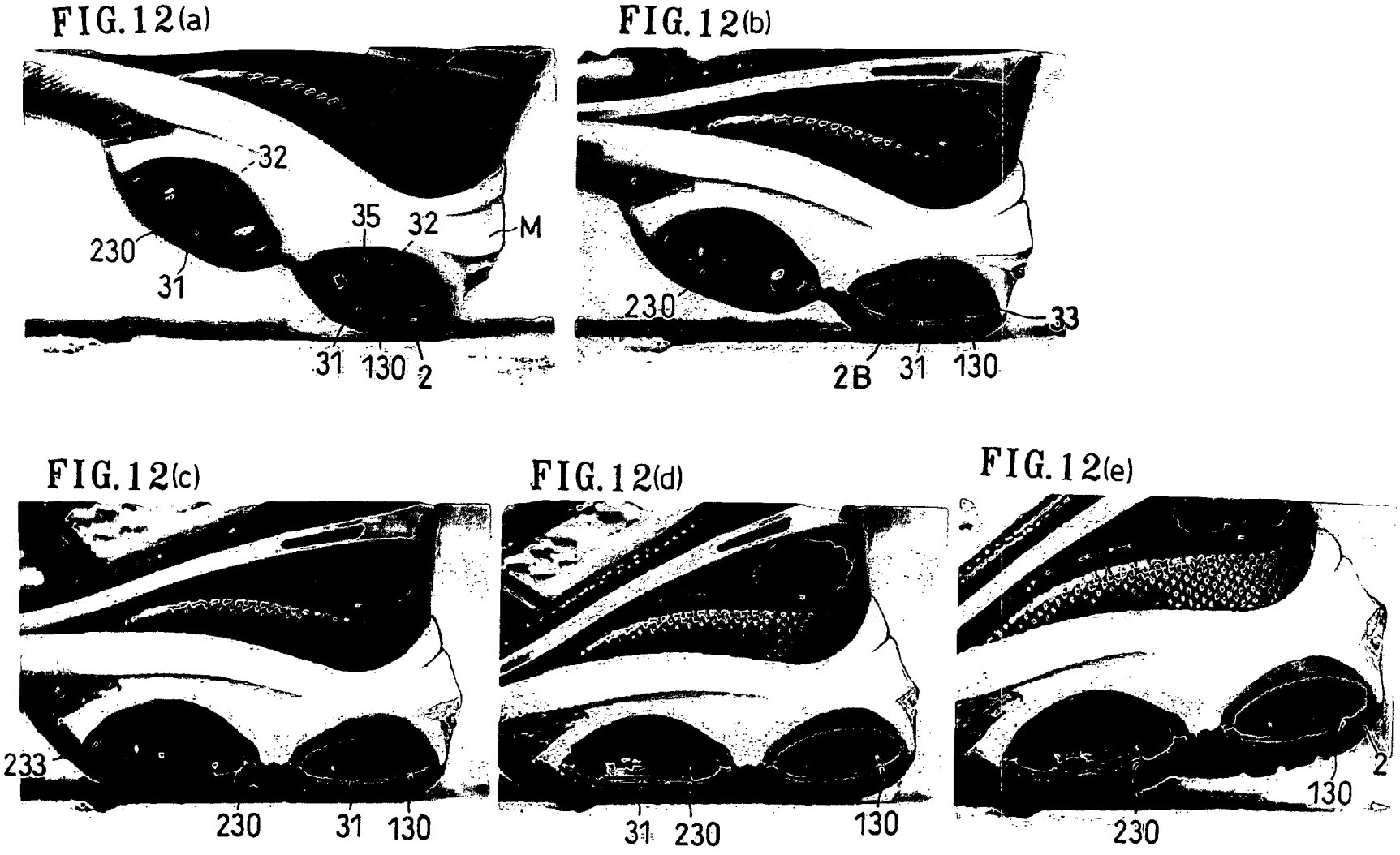
FIGS. 12(*a*) to 12(*e*) are partial lateral side views showing deformation of a rear foot part of the shoe sole according to the first embodiment during landing.
Figure 13A:
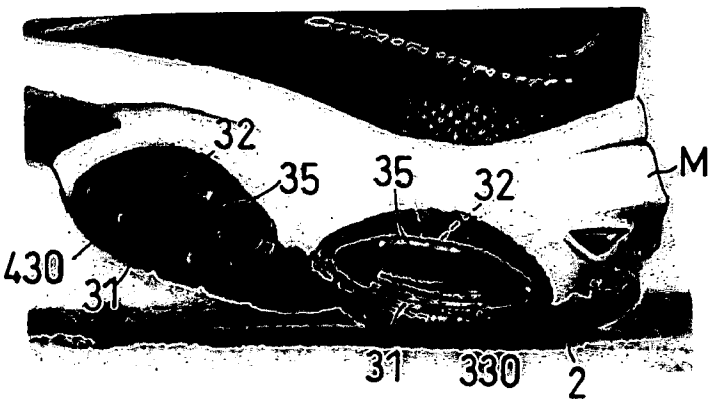
FIGS. 13(*a*) to 13(*d*) are partial medial sectional views showing the deformation of the rear foot part of the shoe sole.
Figure 13B:
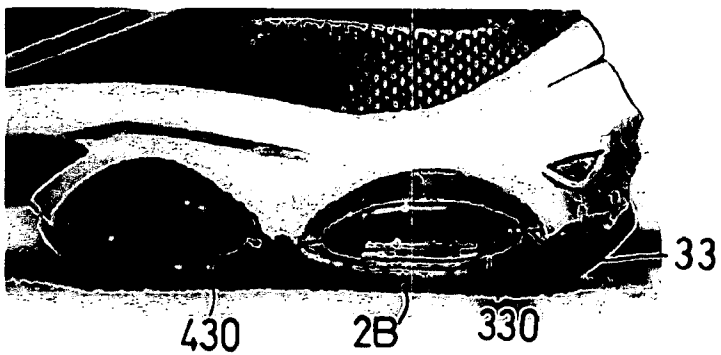
Figure 13C:
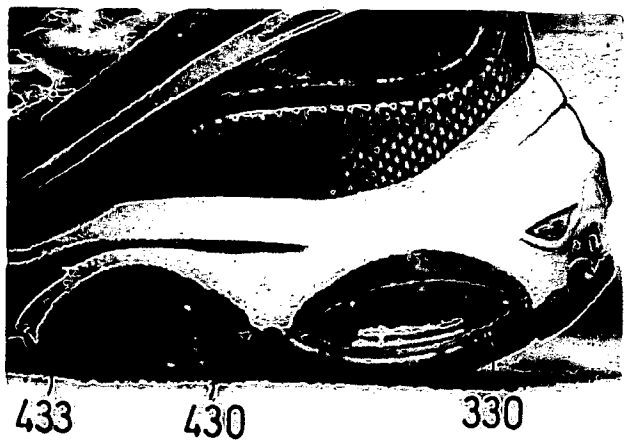
Figure 13D:
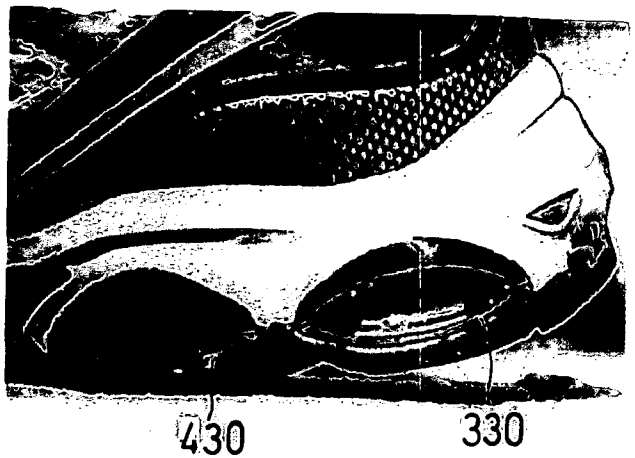
Figure 14A:
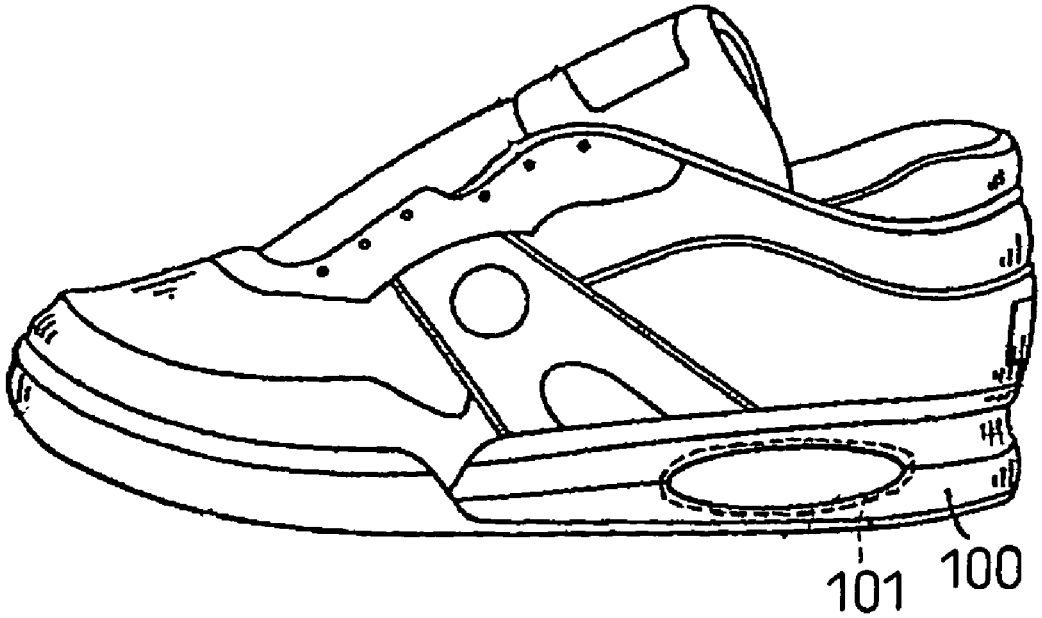
FIG. 14(a) PRIOR ART
FIGS. 14(*a*) and 14(*b*) each show a conventional shoe, FIG. 14(*a*) is a side view of the shoe and FIG. 14(*b*) is a partial notched side view of the shoe.
Figure 14B:
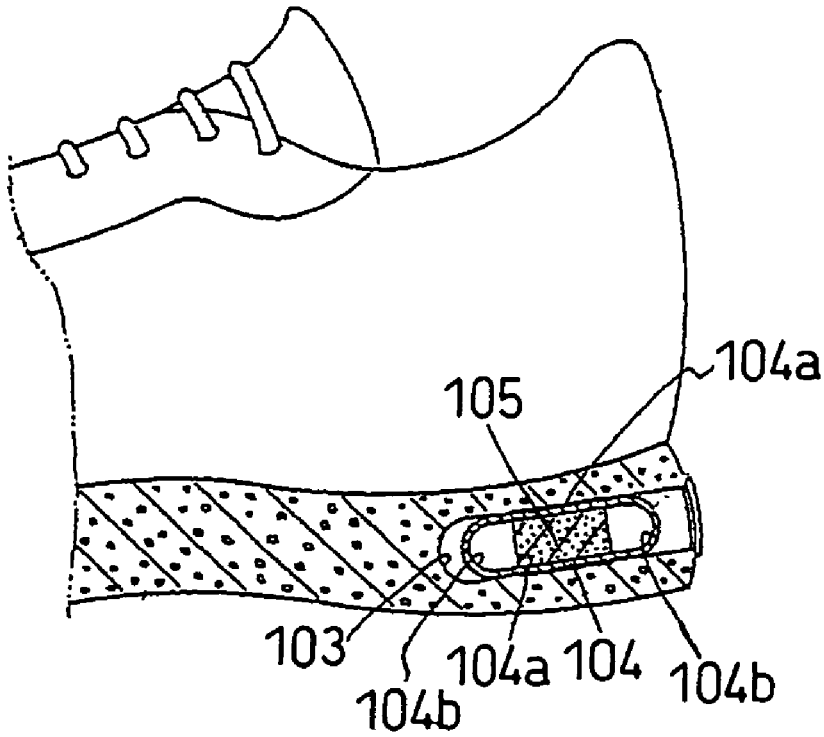
FIG. 14(b) PRIOR ART
Figure 15A:
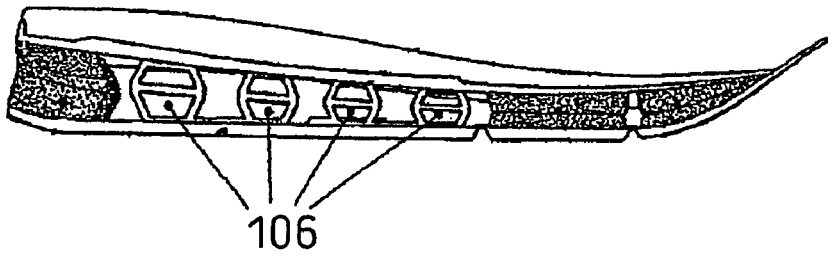
FIG.15(a) PRIOR ART
FIGS. 15(*a*) to 15(*c*) each show a conventional shoe sole, FIG. 15(*a*) is a sectional view of the shoe sole, and FIGS. 15(*b*) and 15(*c*) are perspective views of a deforming member thereof.
Figure 15B:
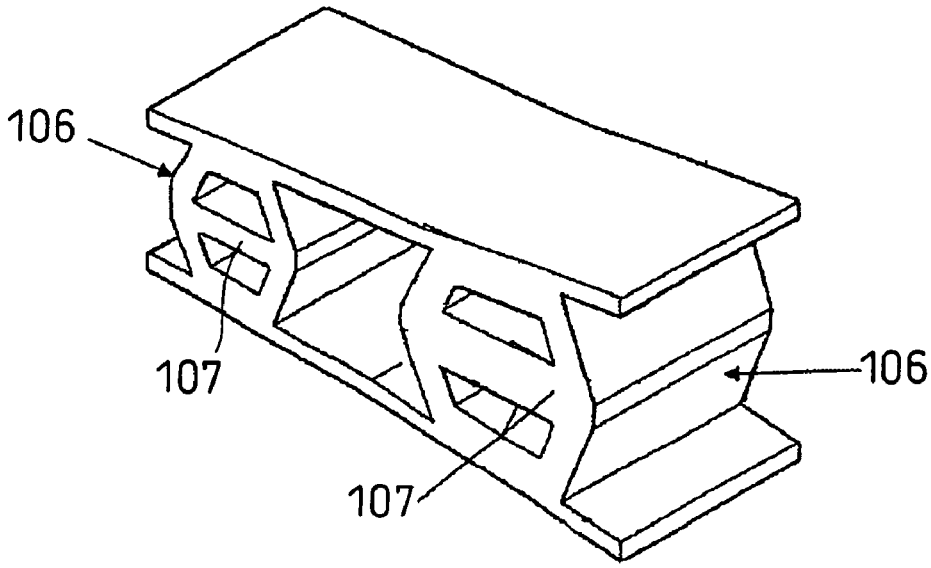
FIG. 15(b) PRIOR ART
Figure 15C:
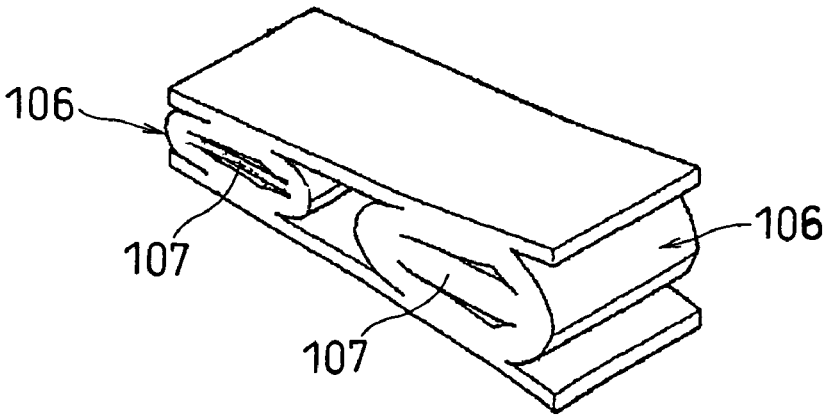
FIG. 15(c) PRIOR ART
Figure 16A:
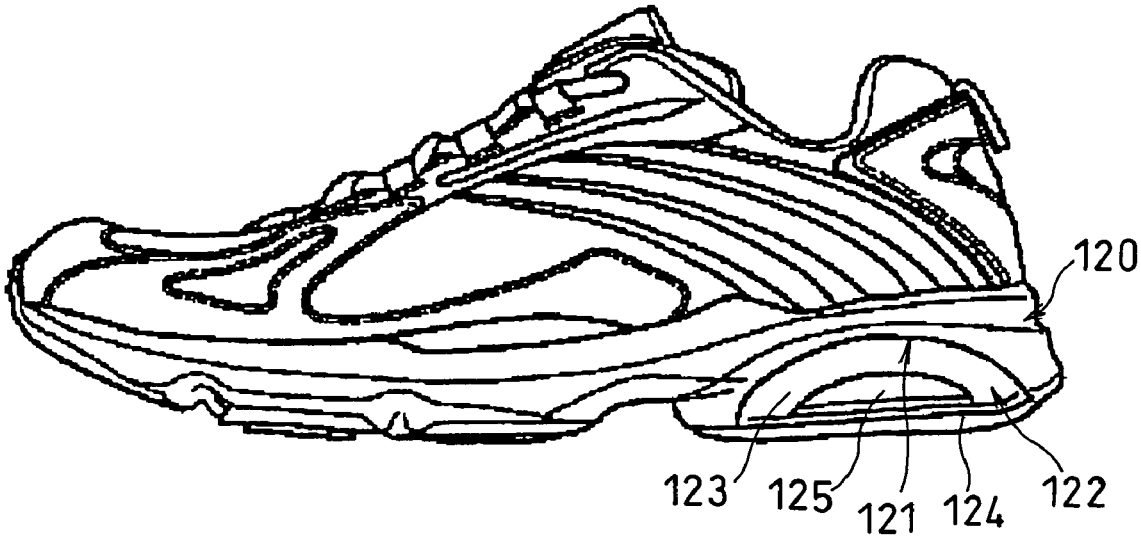
FIG. 16(a) PRIOR ART
FIGS. 16(*a*) and 16(*b*) each show a conventional shoe, FIG. 16(*a*) is a side view of the shoe and FIG. 16(*b*) is a sectional view of the shoe sole.
Figure 16B:
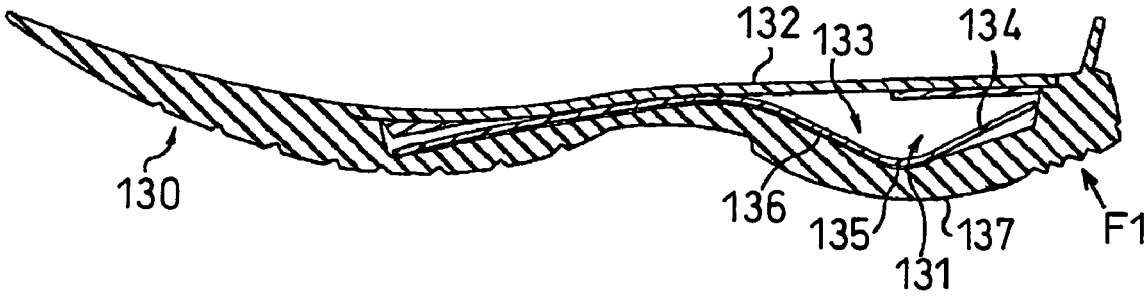
FIG. 16(b) PRIOR ART

FIGS. 12 (*a*) to 12(*e*) are lateral side views showing deformation of the lateral side of the rear foot part of the shoe sole of the first embodiment during landing.

FIG. 12(*a*) shows the state of the shoe sole at the time of the "heel-contact". In this state, the outer sole 2 on the lateral side of the rear foot part firstly lands on the ground and the rear part of the lower portion 31 of the tubular part 130 in the rear of the lateral side of the rear foot part performs a little bending deformation. As shown in FIGS. 12(*b*) and 12(*c*), the lower portion 31 of the tubular part 130 in the rear of the lateral side of the foot performs large bending deformation during the period from the "heel-contact" to the "foot-flat", and therefore, the tubular part 130 compresses in the vertical direction. Subsequently, at the time of the "foot-flat", as shown in FIG. 12(*d*), the lower portion 31 of the tubular part 230 in the fore of the lateral side of the rear foot part performs large bending deformation, and therefore, the tubular part 230 compresses in the vertical direction. At the time of the "mid-stance", the outer sole 2 below the tubular parts 130, 230 on the lateral side of the rear foot part gradually disengage from the ground. Then, at the time of the "heel-rise", as shown in FIG. 12(*e*), the outer sole 2 completely disengages from the ground and both the tubular parts 130, 230 returns to the respective original shape.

FIGS. 13(*a*) to 13(*d*) are medial side views showing deformation of the medial side of the rear foot part of the shoe sole of the first embodiment during landing.

FIG. 13(*a*) shows the state of the shoe sole at the time of the "heel-contact". In this state, the medial side of the shoe sole is out of contact with the ground and the tubular parts 330, 430 on the medial side are undeformed in appearance. Subsequently, during the period from the "foot-flat" to the "mid-stance", as shown in FIG. 13(*b*), both of the tubular parts 330, 430 on the medial side of the rear foot part perform bending deformation, thereby compressing in the vertical direction. Next, as shown in FIG. 13(*c*), bending deformation of the tubular part 430 in the fore of the medial side of the rear foot part is further increased. At the time of the "heel-rise", as shown in FIG. 13(*d*), the tubular part 430 in the fore of the medial side of the rear foot part starts to return to the original shape and at the time of the "toe-off" when the heel is completely lifted, the outer sole 2 of the rear foot part disengages from the ground and the tubular part 430 in the fore of the medial side of the rear foot part returns to the original shape.

As described above, while the lower portions 31 of the tubular parts 130, 230, 330 and 430 undergo large bending deformation on the lateral and medial sides of the foot, the upper portions 32 of the tubular parts 130, 230, 330 and 430 perform relatively small bending deformation, during the period from the "heel-contact" to the "heel-rise", as shown FIGS. 12(*a*) to 13(*d*).

During a series of motions from the time of the "heel-contact" to the time of the "heel-rise", the lower portions 31 of the tubular parts 130, 230, 330 and 430 perform bending deformation and, as shown in FIGS. 12(*c*) and 13(*c*), end portions 233, 433 in the front side of the tubular parts 230, 430 in the fore of the rear foot part displace a little in the longitudinal direction with respect to the midsole M. The displacement of the end portions 233, 433 allows large bending deformation of the lower portions 31. It is speculated that the upper portions 32 is preferably curved to some extent so as to allow displacement of the end portions 233, 433.

On the lateral side of the rear foot part, the shoe sole sequentially makes contact with the ground forward from its rear end part and accordingly, the position on which a load is imposed is gradually moved forward. Therefore, by disposing the two tubular parts 130, 230 on the lateral side of the rear foot part of the shoe sole along the longitudinal direction, it is possible to effectively absorb shock over the whole area on the lateral side of the rear foot part.

On the other hand, on the medial side of the rear foot part, while the forward tubular part 430 undergoes large bending deformation, the rearward tubular part 330 undergoes small bending deformation. This is believed to be due to that, on the medial side of the rear foot part, the portion near the arch is subjected to a large load, while the portion near the heel is subjected to a small load. Therefore, the tubular part 330 in the rear of the medial side of the rear foot part may be replaced with the midsole M.

As understood from the fact that bending deformation of the tubular parts 330, 430 on the medial side of the rear foot part is larger than that of the tubular parts 130, 230 on the lateral side of the rear foot part, the foot can may incline toward the medial side during landing. To prevent this inclining for improving stability, in the deformation test, a vertical compression stiffness per unit area of each deformation element 3 on the lateral side of the rear foot part is set smaller than that of each deformation element 3 on the medial side of the rear foot part. As described above, this setting is achieved by making the Young's modulus of the shock absorbing member 35 in the tubular parts 330, 430 on the medial side larger than the Young's modulus of the shock absorbing member 35 in the tubular parts 130, 230 on the lateral side, or making stiffness of the tubular parts 330, 430 larger than stiffness of the tubular parts 130, 230 on the lateral side.

As described above, on the medial side of the rear foot part, the load imposed on the rearward tubular part 330 is far smaller than the large load imposed on the forward tubular part 430. Therefore, the compression stiffness of the forward deformation element (near the arch) of the two deformation elements on the medial side of the rear foot part may be set to be larger than that of the deformation element on the lateral side of the rear foot part and that of the deformation element in the rear of the medial side of the rear foot part.

The rear end portions 33 of the rearward tubular parts 130, 330 are disposed in the vicinity of the rear end of the outer sole 2. That is, the rear end portions 33 of the tubular parts 130, 330 are disposed at the rearmost position when the shoe sole makes contact with the ground. The lower portions 31 of the rearward tubular parts 130, 330 are formed in a substantially smooth arc shape in the longitudinal sectional view of the shoe sole (FIG. 4).

With the tubular parts 130, 330 thus formed, in the period during which the state of the heel-contact where the foot lands on the ground as shown in FIG. 11(*a*) transfers to the state of the foot-flat where almost whole of the sole of the foot is in contact with the ground as shown in FIG. 11(*b*), the impact load due of landing is sequentially imposed on the tubular parts 130, 330 forwards from the rearward as shown in FIGS. 12(*a*) to 12(*c*) and FIGS. 13(*a*) to 13(*c*). That is, during the transfer of the state, the position of the tubular parts 130, 330 on which the load is imposed continuously moves from the vicinity of the rear end portions 33 of the lower portions 31 of the tubular parts 130, 330 toward the fore part thereof until it gets to the center of the lower portions 31 in the longitudinal direction.

By receiving the load in this manner, the lower portions 31 of the tubular parts 130, 330 undergo bending deformation sequentially from the rear toward the front thereof. That is, by receiving the load in this manner, the region of the lower portions 31 of the tubular parts 130, 330 that undergoes bending deformation sequentially moves from the vicinity of the rear end portions 33 of the lower portions 31 toward the fore part thereof until it gets to the center of the lower portions 31 in the longitudinal direction, and furthermore, the region forward of the center also undergoes bending deformation.

Thus, since continuity of deformation is maintained and impact load of landing is absorbed continuously all over the period during which the state transfers, shock absorption function is enhanced. Moreover, since the deformed tubular parts 130, 330 return to the original shape during the transfer period or thereafter, the stored energy can be returned.

As shown in FIG. 4, two deformation elements 3 are arranged in the rear foot part of the foot along the longitudinal direction X. One deformation element (first deformation element) 3 of the two deformation elements 3 is disposed so that its rear end portion 33 is located in the vicinity of the rear end of the second outer sole 2B. Furthermore, the other deformation element (second deformation element) 3 of the two deformation elements 3 is disposed so that its rear end portion 33 is located in the vicinity of the rear end of the arch portion of the midsole M (the front end of the rear foot part of the midsole M). That is, the front half of the lower portion 31 of the forward tubular part 30 in FIG. 1 is curved along the arch shape of the arch portion of the foot.

In this manner, the deformation elements 3 in FIG. 4 are arranged so that the end portions 33 are located at front and rear ends of the rear foot part of the midsole M and that each end portion 33 is away from the road surface in all states during landing. For this reason, when the lower portions 31 deforms during landing, the end portions 33 are easy to be displaced in the longitudinal direction. That is, the tubular part 30 can perform bending deformation even when the midsole M is not strongly pushed aside by the end portions 33 of the deformation elements in the longitudinal direction.

Furthermore, since a plurality of deformation elements 3 each are provided in the fore and rear of the rear foot part, the foot of the wearer can be stably supported at the time of the foot-flat or in a standing position.

The front end portion 33 of the rearward deformation element 3 and the rear end portion 33 of the forward deformation element 3 are arranged so as to be close to each other in the longitudinal direction of the foot. This arrangement allows the longitudinal diameter Lr of each of the plurality of deformation elements 3 to be set large and thus, shock absorption function and energy storage function of the deformation elements 3 are improved.

In consideration of this, it is preferred that the deformation elements 3 are arranged separately from each other in the longitudinal direction of the foot.

Second Embodiment

Figure 5:
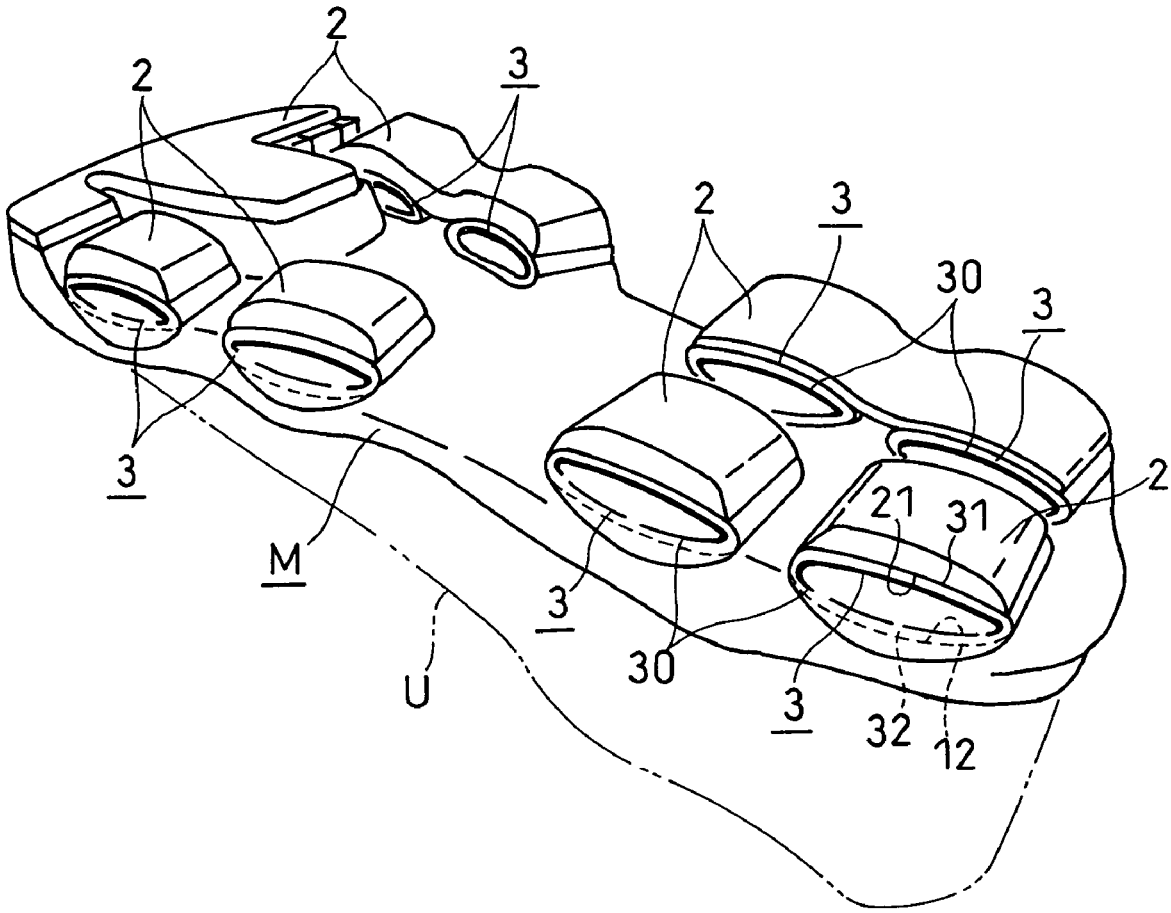
FIG. 5 is a perspective view of a shoe according to a second embodiment of the present invention viewed from the bottom surface side.
Figure 6A:
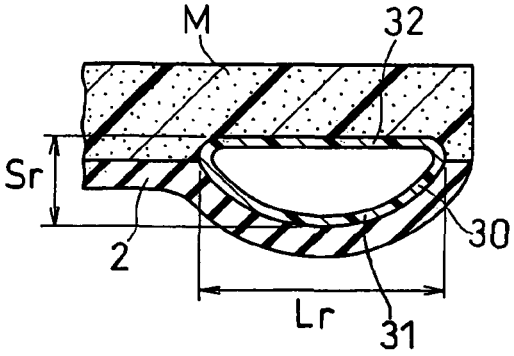
FIGS. 6(*a*) to 6(*c*) are partial sectional views showing an example of the shoe sole of the present invention, and FIGS. 6(*d*) to 6(*f*) are partial sectional views showing an example of the shoe sole that is not included in the present invention.
Figure 6D:
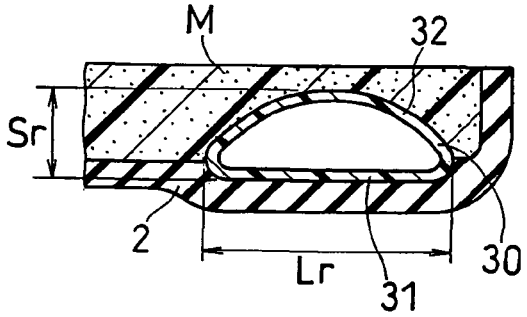
Figure 6B:
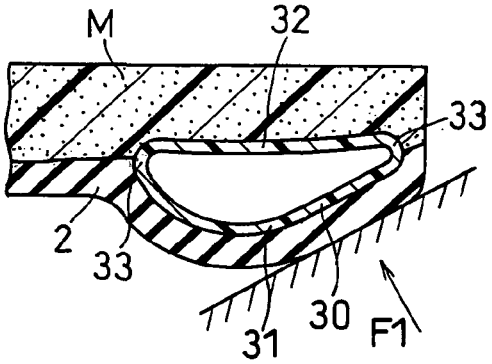
Figure 6E:
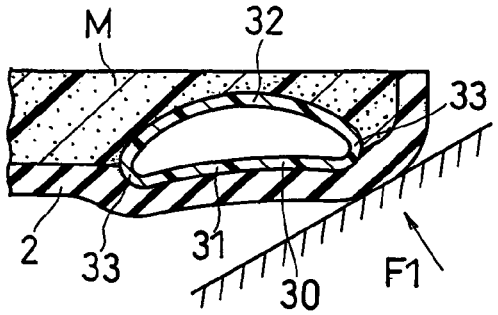
Figure 6C:
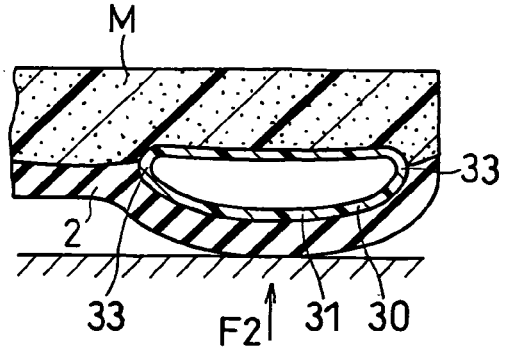
Figure 6F:
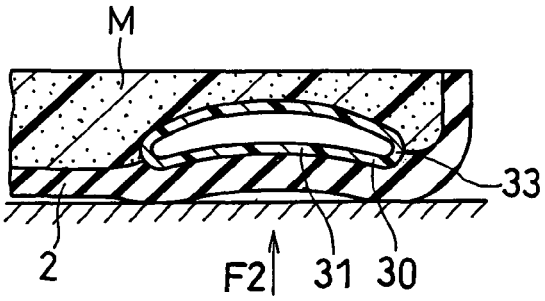

FIG. 5 shows the second embodiment. Note that, in the description of the following embodiments, the parts which are identical or corresponding to those of the first embodiment are designated by the same reference numerals as the first embodiment and the detailed description thereof will be omitted.

In this embodiment, as shown in FIG. 5, the deformation elements 3 is also provided on the medial and lateral sides of the fore foot part of the foot in addition to the rear foot part of the foot. This deformation element 3 consists of the tubular part 30. That is, unlike the first embodiment, there is no cushioning member within the tubular part 30, and therefore, the tubular part 30 is hollow on the inside.

In this embodiment, the connecting member for retaining the tubular part 30 is not provided, and the upper portion 32 of the tubular part 30 (lower half of the tubular part 30 in FIG. 5) is directly fit into the second curved surface 12 of the midsole M. The upper portion 32 of the tubular part 30 of this embodiment is formed to be rolling upwards at the lateral side face and the medial side face of the foot.

The outer sole 2 is adhesive bonded onto the lower portion 31 of the tubular part 30 (upper half of the tubular part 30 in FIG. 5). On the lateral side of the rear foot part, unlike the first embodiment, the outer sole 2 is divided into two, which are spaced apart from each other to cover the respective tubular part 30. On the medial side of the rear foot part, similarly to the first embodiment, the outer sole 2 is provided continuously so as to cover two tubular parts 30 arranged along the longitudinal direction. In this embodiment, the midsole M is integrally formed without being divided.

Third Embodiment

Figure 17:
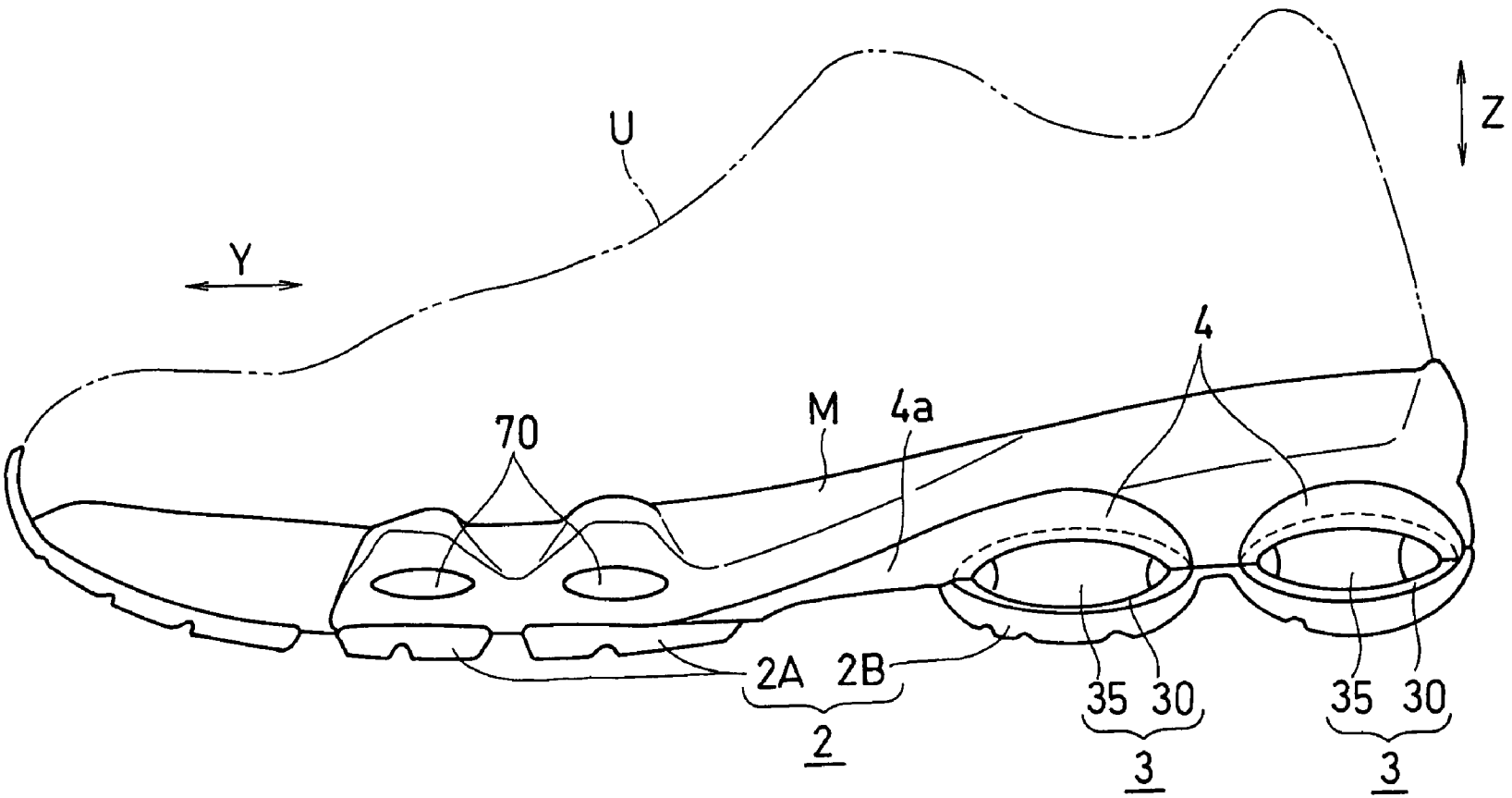
FIG. 17 is a lateral side view of the shoe according to the third embodiment.
Figure 18:
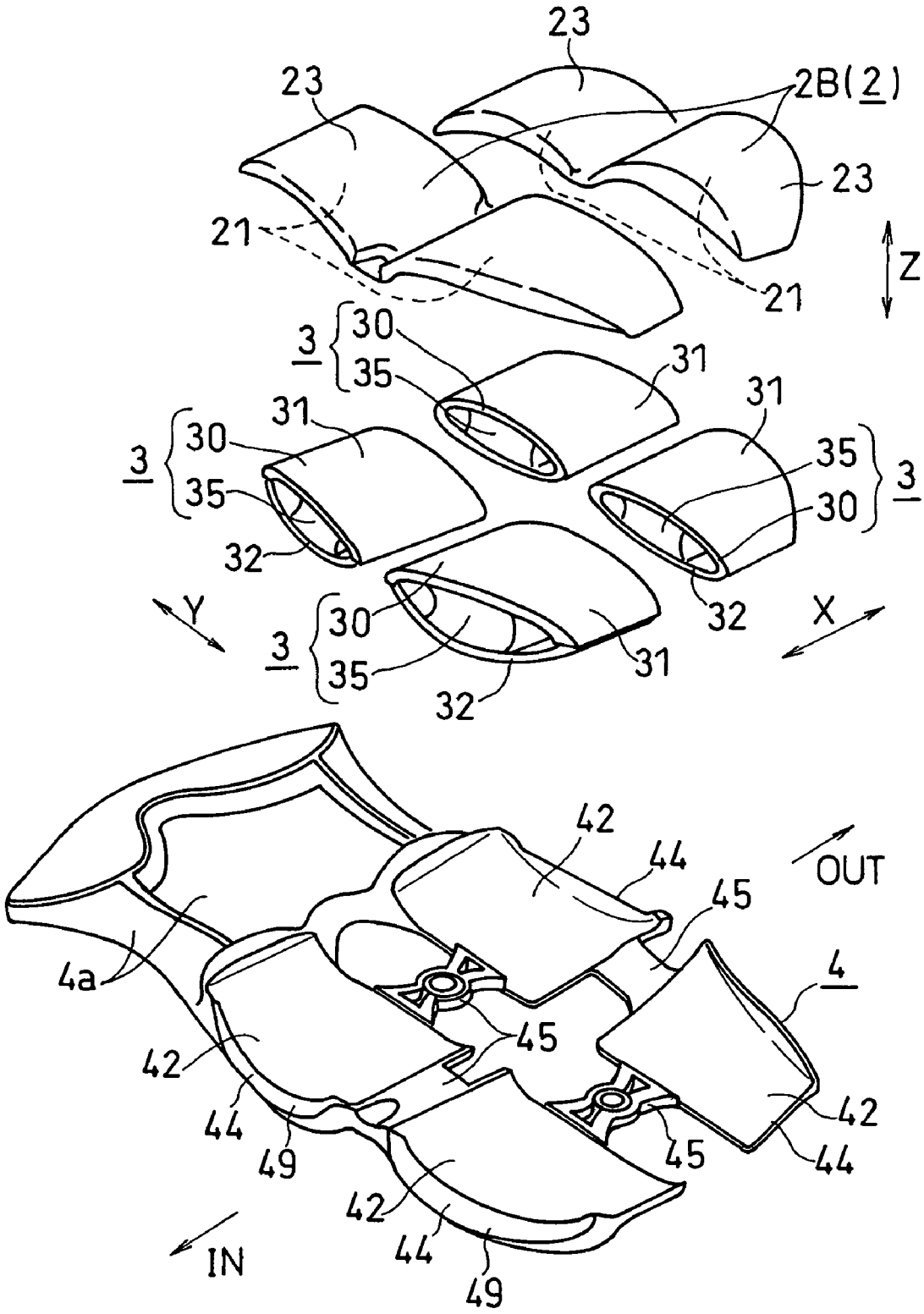
FIG. 18 is an exploded perspective view of the outer sole, the deformation element and the connecting member viewed from the bottom surface side.
Figure 19A:
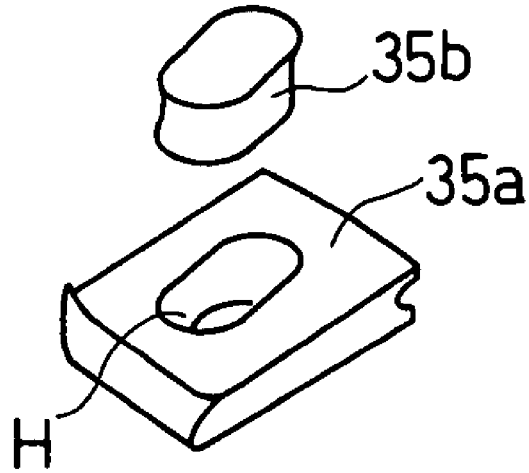
FIGS. 19(*a*) and 19(*b*) are exploded perspective views of the cushioning member.
Figure 19B:
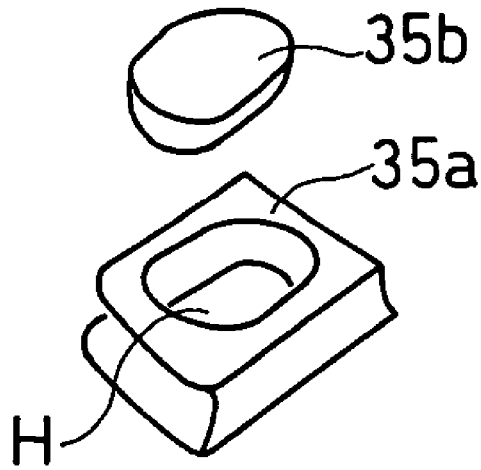

FIGS. 17 to 19 show the third embodiment.

In this embodiment, as shown in FIG. 17, the connecting member 4 is provided so as to extend from the rear foot part to the arch portion of the foot. A portion of the connecting member located on the arch portion of the foot constitutes a shank (reinforcing device) 4*a* for restraining distortion of the arch portion.

For example, a structure as disclosed in WO2005/037002 (PCT/JP2004/015042), the content of which is hereby incorporated herein by reference, may be employed for this shank 4*a*.

In this embodiment, the Young's modulus of the connecting member 4 is set larger than that of the midsole M and smaller than that of the tubular part 30, while, in the first embodiment, the Young's modulus of the connecting member 4 is about the same as that of the tubular part 30. Since such setting of this embodiment enables the connecting member 4 to retain the tubular parts 30 more softly, the upper portion 32 (FIG. 18) of the tubular part 30 can be expected to undergo bending deformation.

As shown in FIG. 18, in this embodiment, a width and a thickness of the connection bar 45 on the medial side IN of the rear foot part of the foot are set larger than those of the connection bar 45 on the lateral side OUT of the rear foot part of the foot, respectively. Such settings allows the tubular parts 30 on the lateral side of the foot, which side is subjected to large impact load of landing at the time of the heel contact, to deform to a greater extent.

As shown in FIGS. 19(*a*) and 19(*b*), in this embodiment, the cushioning member consists of a first cushioning member 35*a* formed of gel and a second cushioning member 35*b* formed of resin foam of EVA etc. A hole H is formed approximately in the center of the first cushioning member (longitudinal center of the tubular part 30), which hole has an axis substantially parallel to the minor axis of the tubular part 30. The second cushioning member 35*b* is fit into this hole H, thereby filling the hole H substantially completely. This hole H may be formed to pass through the first cushioning member 35*a* vertically as shown in FIG. 19(*a*), or may be formed by providing a concave portion (not passing therethrough) on the upper surface of the first cushioning member 35*a* as shown in FIG. 19(*b*).

The second cushioning member 35*b* is made of a material that is softer and lighter than the first cushioning member 35*a*. This serves for weight saving and the increase in range of motion of gel, and therefore the repulsion force of the tubular part 30 can be enlarged and the endurance of the gel can be improved. Furthermore, since the hole H is located approximately in the longitudinal center of the tubular part 30, the cushioning members help to the deformation of the tubular part 30 so that the deformation in the vicinity of the end portions may be decreased and the deformation approximately in the center of the tubular part 30 may be increased.

Shock Absorption Function of Tubular Part:

Hereinafter, the result of the simulation of the case where static load was applied onto the tubular part disposed in the rear foot part will be shown in order to make clear the effect of the present invention.

First and second models were prepared: in the first model (FIG. 6(*a*)), the lower portion 31 of the tubular part 30 was formed to be convex downwards and the upper portion 32 was formed to be flat (uncurved); in the second model (FIG. 6(*d*)), the lower portion 31 of the tubular part 30 was formed to be flat (uncurved) and the upper portion 32 was formed to be convex upwards.

In these models, the length of the major axis Lr was set at 40.66 mm, the length of the minor axis Sr was set at 16 mm, the thickness of the tubular part 30 was set at 2 mm and the thickness of the outer sole was set at 5 mm. The radius of curvature of the lower portion 31 of the tubular part 30 in FIG. 6(*a*) and the radius of curvature of the upper portion 32 of the tubular part 30 in FIG. 6(*d*) were each set at 25 mm. This simulation was run with the depth of each member of these models set at 1 mm, and therefore this is a result of a two-dimensional analysis.

In both models, Young's modulus of the tubular part 30 was set at 5.0 kgf/mm$^2$ and Poisson's ratio of the tubular part 30 was set at 0.4; Young's modulus of the midsole M is set at 0.2 kgf/mm$^2$ and Poisson's ratio of the midsole M is set at 0.01; Young's modulus of the outer sole 2 is set at 0.5 kgf/mm$^2$ and Poisson's ratio of the outer sole 2 is set at 0.49.

First, in each model, the rear end of the shoe sole was pressed onto an inclined surface inclined at about 30 degrees to the horizontal as shown in FIGS. 6(*b*), 6(*e*), and thus a static load F1 was applied onto the shoe sole obliquely from rearward below as a supposed load at the time of landing. In the first model, the load F1 was set at about 0.35 kgf. In the second model, the load F1 was set at about 0.83 kgf, because the same load as the first model could make little deformation.

Consequently, in the first model, as shown in FIG. 6(*b*), the lower portion 31 of the tubular part 30 underwent large bending deformation. At this time, the rear portion of the lower portion 31 deformed so as to be generally parallel to the inclined surface. On the other hand, in the second model, as shown in FIG. 6(*e*), the lower portion 31 of the tubular part 30 underwent only far smaller bending deformation than the first model although the load was more than doubled relative to the first model.

Next, in each model, the rear portion of the shoe sole was pressed onto the horizontal surface as shown in FIGS. 6(*c*), 6(*f*), and thus a static load F1 was applied onto the shoe sole from below. In the first model, the load F2 was set at about 0.33 kgf. In the second model, the load F2 was set at about 1.31 kgf, because the same load as the first model could make little deformation.

Consequently, in the first model, as shown in FIG. 6(*c*), the lower portion 31 of the tubular part 30 underwent large bending deformation. At this time, the central portion of the lower portion 31 deformed so as to be generally parallel to the horizontal surface. On the other hand, in the second model, as shown in FIG. 6(*f*), the lower portion 31 of the tubular part 30 underwent only far smaller bending deformation than the first model although the load was more than tripled relative to the first model. Below the central portion of the lower portion 31 of the tubular part 30, the outer sole 2 became spaced apart from the horizontal surface.

From these results, in the first model, it is speculated that the tubular part 30 can absorb much of the impact energy because the bulging lower portion 31 to be convex downwards undergoes bending deformation in spite of the direction of the loads F1, F2. On the other hand, in the second model, it is speculated that most of the impact energy is transferred to a portion of the midsole M above the end portion 33 because the flat (uncurved) lower portion 31 undergo only a small bending deformation in spite of the direction of the loads F1, F2.

From the above result of the simulation, it is speculated that, if the lower portion 31 is curved to be convex downwards and protruding from the midsole, the tubular part 30 can perform the shock absorption function sufficiently against the impact of landing. That is, it is speculated that, if the lower portion 31 of the tubular part 30 is curved to be convex downwards and protruding from the midsole, the tubular part 30 can store the impact energy of landing as deformation energy and therefore perform the repulsion function, sufficiently due to its leaf spring structure. However, if the whole of the lower portion 31 of the tubular part 30 is formed flat (uncurved) or if the lower portion 31 is not protruding downwards from the midsole, the tubular part 30 is difficult to undergo bending deformation, and therefore the tubular part 30 cannot absorb the shock of landing and cannot perform the repulsion function sufficiently. Accordingly, the first model (FIGS. 6(*a*) to 6(*c*)) falls within the scope of the present invention, while the second model (FIGS. 6(*e*) to 6(*f*)) is outside the scope of the present invention.

Various modified modification may be applied to the shapes of the tubular part 30, the outer sole 2 and the midsole 1.

Figure 7:
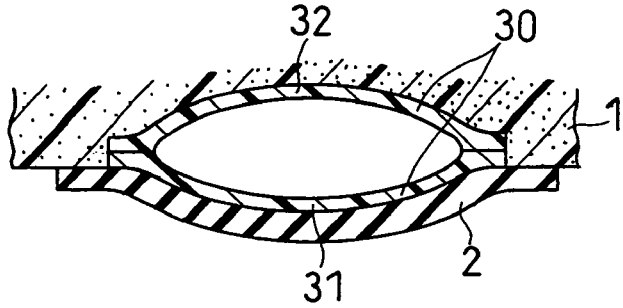
FIGS. 7(*a*) to 7(*e*) are partial sectional views showing modifications of the shoe sole of the present invention.
Figure 7:
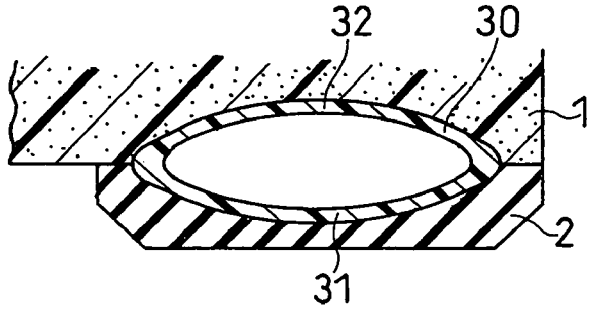
Figure 7:
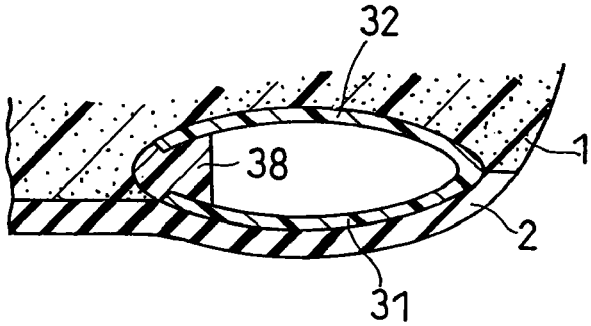
Figure 7:
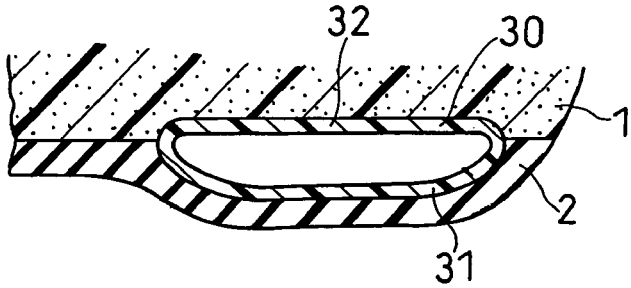
Figure 7:
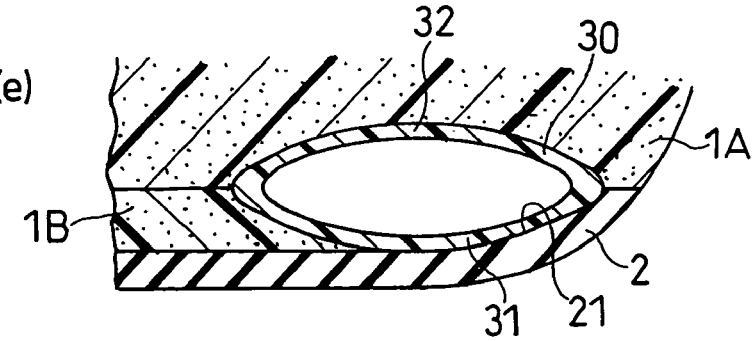
Figure 8A:
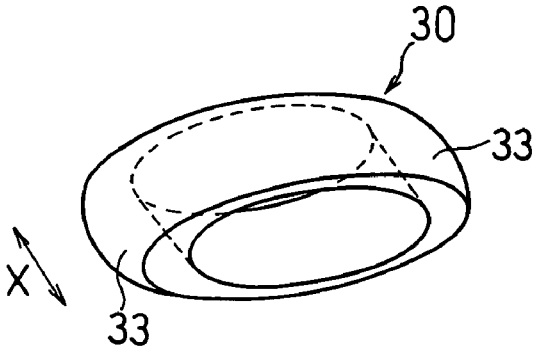
FIGS. 8(*a*) to 8(*e*) are perspective views showing modifications of a tubular part.
Figure 8B:
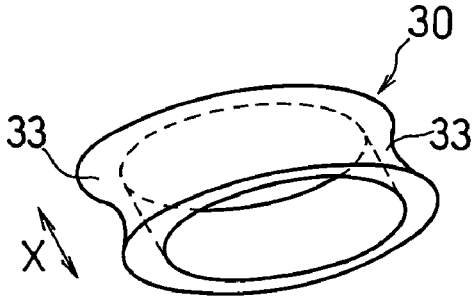
Figure 8C:
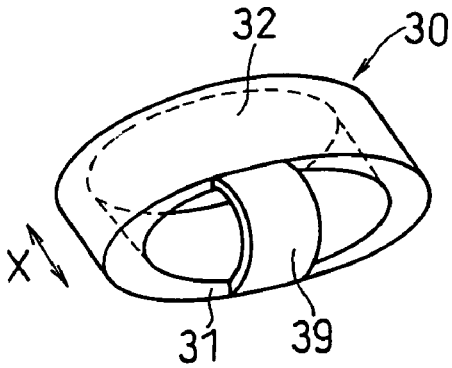
Figure 8D:
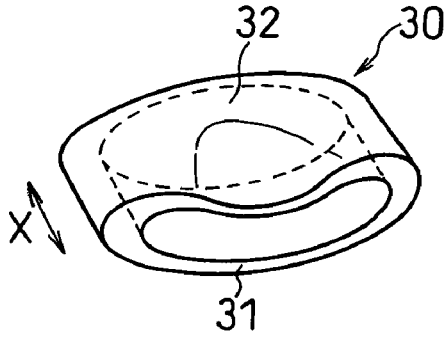
Figure 8E:
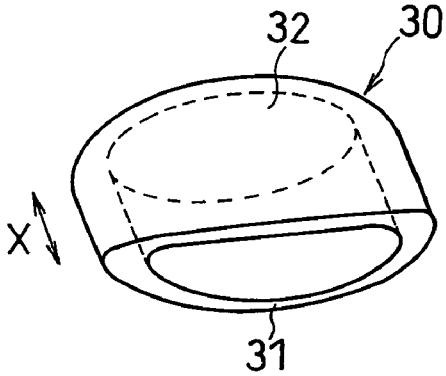
Figure 9A:
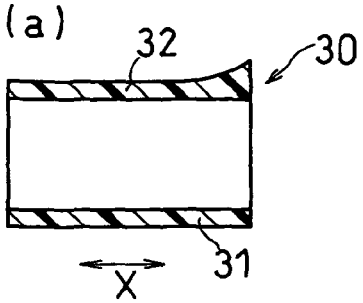
FIGS. 9(*a*) to 9(*i*) show modifications of the tubular part, FIGS. 9(*a*), 9(*b*), 9(*c*) and 9(*i*) are sectional views along the medial-lateral direction of the foot, and FIGS. 9(*d*) to 9(*h*) are sectional views along the longitudinal direction of the foot.
Figure 9B:
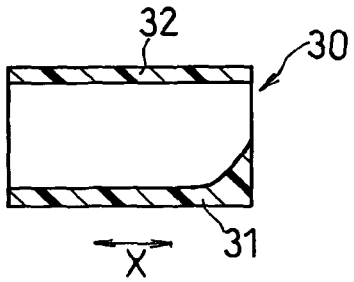
Figure 9C:
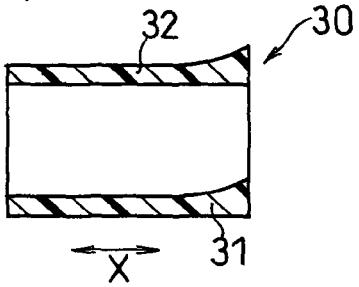
Figure 9D:
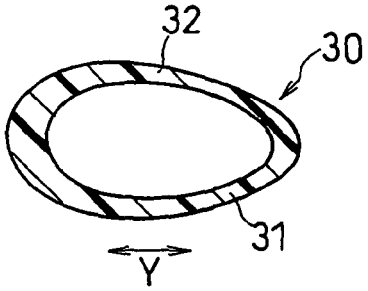
Figure 9E:
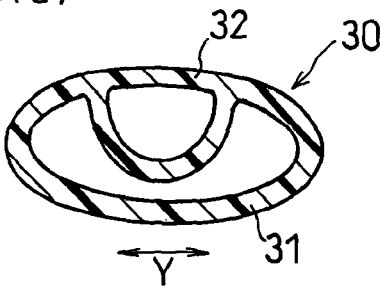
Figure 9F:
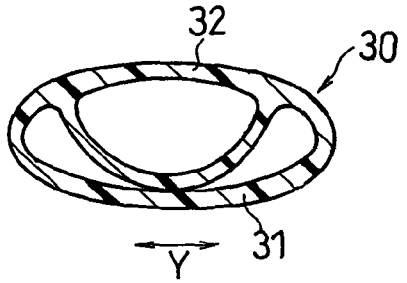
Figure 9G:
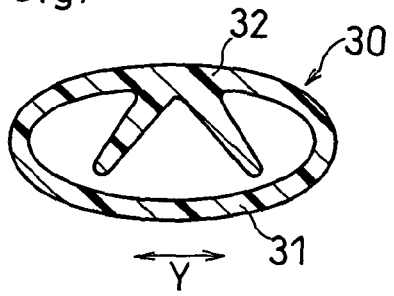
Figure 9H:
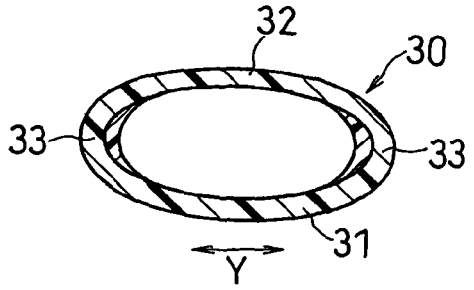
Figure 9I:
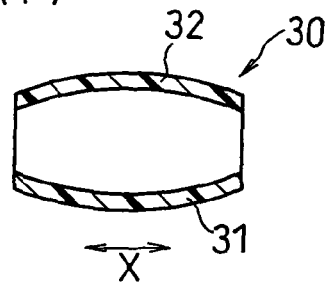
Figure 10A:
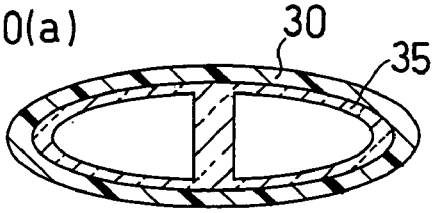
FIGS. 10(*a*) to 10(*h*) are sectional views showing modifications of the cushioning member.
Figure 10D:
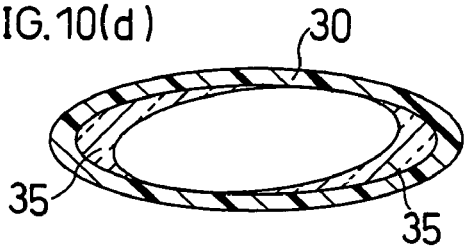
Figure 10B:
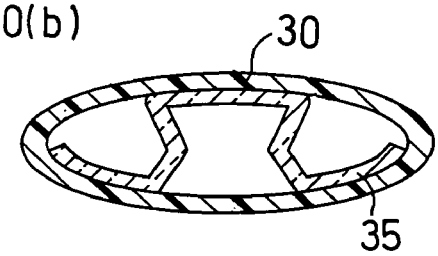
Figure 10E:
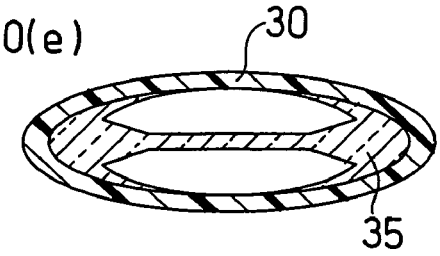
Figure 10C:
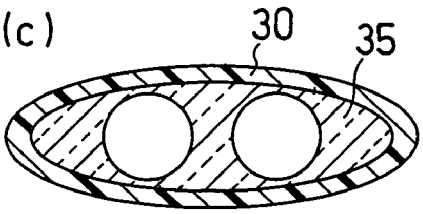
Figure 10F:
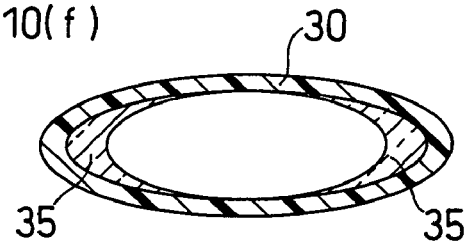
Figure 10G:
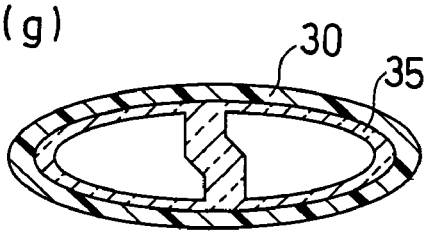
Figure 10H:
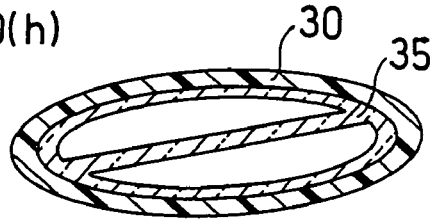

For example, as shown in FIG. 7(*a*), the tubular part 30 may be formed by two curved plates that are joined to each other at their end portions. The outer sole 2 need not necessarily be curved along the lower portion 31 of the tubular part 30, and the ground contact surface of the outer sole 2 may be formed flat below the tubular part 30 as shown in FIG. 7(*b*).

The tubular part 30 need not necessarily be formed to be completely ring-shaped, and it may be formed by a modified tubular part 30 having a discontinuity in the longitudinal section and a end member 38 of rubber etc. which is disposed at this discontinuity, as shown in FIG. 7(*c*).

As shown in FIG. 7(*d*), the lower portion 31 may be formed so that its central portion is flat (uncurved) and that its front and rear portions are curved. In this case, since the lower portion 31, on the whole, protrudes downwards from the midsole, the lower portion 31 can undergo sufficient bending deformation due to the shock of landing.

As shown in FIG. 7(*e*), the tubular part 30 may be disposed to be sandwiched between the upper and lower midsole bodies 1A, 1B with only the rear part of the lower portion 31 of the tubular part 30 protruding from the lower surface of the midsole 1. The first curved surface 21 may be provided partially below the lower portion 31 of the tubular part, and even such partial curvedness can provide the merit of the curvedness.

Alternatively, the tubular part 30 may be formed in shapes shown in perspective views of FIGS. 8(*a*) to 8(*e*) or in shapes shown in sectional views of FIGS. 9(*a*) to 9(*h*).

That is, as shown in FIGS. 8(*a*), 8(*b*), the outer surface of the tubular part may be curved along the medial-lateral direction X at the front and rear end portions 33, 33. As shown in FIG. 8(*c*), a bent connecting part may be provided, which part connects the lower portion 31 and the upper portion 32. As shown in FIG. 8(*d*), a concave curved surface may be provided partially on the upper portion 32 of the tubular part 30. As shown in FIG. 8(*e*), one of medial and lateral end portions of the upper portion 32 of the tubular part 30 may be flat with the other of the end portions being curved.

As shown in FIGS. 9(*a*) to 9(*c*), the upper portion 32 and/or the lower portion 31 the tubular part 30 may be formed so that its medial or lateral end portion curls upwards. As shown in FIG. 9(*d*), the tubular part 30 may be formed so that its curvature is different between the front portion and the rear portion. As shown in FIGS. 9(*e*), 9(*f*), the internal space of the tubular part 30 may be divided into two so that a small cell is provided below the upper portion 32. As shown in FIG. 9(*g*), a bifurcated part extending from the upper portion 32 may be provided in the internal space of the tubular part 30. As shown in FIG. 9(*h*), for the purpose of reinforcing the front and rear end portions 33, 33 of the tubular part 30, other members may be disposed and joined onto the inner surface of these end portions 33, 33. As shown in FIG. 9(*i*), the upper portion 32 and the lower portion 31 of the tubular part 30 may be curved in the section along the medial-lateral direction X. The entire outer surface of the tubular part 30 may be curved both in the longitudinal direction and in the medial-lateral direction to form ellipsoidal surface.

While preferred embodiments of the present invention have been described above with reference to the drawings, obvious variations and modifications will readily occur to those skilled in the art upon reading the present specification.

For example, although, in the first and third embodiment, the cushioning member 35 is arranged approximately in the longitudinal center of the internal space of the tubular part 30, the shape and the arrangement of the cushioning member 35 is not limited to those of these embodiments. Alternatively, the cushioning member may be shaped and arranged as shown in FIGS. 10(*a*) to 10(*h*).

The number and the arrangement of the deformation elements is not limited to those of the embodiments. For example, two or three deformation elements or more than five elements may be arranged in the rear foot part. The deformation elements may be provided only in the lateral side in the rear foot part.

Thus, such variations and modifications shall fall within the scope of the present invention as defined by the appended claims.

INDUSTRIAL APPLICABILITY

The present invention is applicable to shoe soles of various shoes such as athletic shoes.

The invention claimed is:

1. A shock absorbing device for a shoe sole comprising:

an outer sole having a ground contact surface that contacts the ground at landing and an upper surface opposite to the ground contact surface;

a midsole that is disposed above the outer sole and has a bottom surface; and a deformation element disposed between the outer sole and the midsole, wherein the deformation element is joined to the bottom surface of the midsole and is joined to the upper surface of the outer sole, the deformation element has a tubular part in a flat tubular form, Young's modulus of a material constituting the tubular part is greater than both that of a material constituting the midsole and that of a material constituting the outer sole, the tubular part is arranged so as to have a major axis generally along a longitudinal direction of a foot and a minor axis generally along a vertical direction, a length of the major axis is set within a range of about 25 mm to about 80 mm, the tubular part has a lower portion that is curved so as to be convex downwards and thereby undergoes bending deformation due to an impact load of landing, a concave first curved surface is provided on the upper surface of the outer sole, the lower portion of the tubular part fits into the first curved surface of the outer sole, a connecting member having a greater Young's modulus than the midsole is joined to the bottom surface of the midsole, the tubular part is joined to the connecting member, and by joining the tubular part to the connecting member, the deformation element is retained by the connecting member.

2. A shock absorbing device for a shoe sole according to claim 1, wherein the tubular part has an upper portion that is curved so as to be convex upwards and thereby undergoes bending deformation due to the impact load of landing, a concave second curved surface is provided on the bottom surface of the midsole, and the upper portion of the tubular part fits into the second curved surface of the midsole.

3. A shock absorbing device for a shoe sole according to claim 2, wherein a length of the minor axis of the tubular part is set within a range of about 8 mm to about 25 mm, and flatness obtained by dividing the length of the major axis by the length of the minor axis of the tubular part is set within a range of about 1.5 to about 4.0.

4. A shock absorbing device for a shoe sole according to claim 1, wherein a third curved surface that is curved so as to be convex downwards generally along the lower portion of the tubular part is provided on the ground contact surface of the outer sole.

5. A shock absorbing device for a shoe sole according to claim 4, wherein the tubular part has a front end portion in front of the lower portion and a rear end portion in the rear of the lower portion, the tubular part is integrally formed to be seamless in a longitudinal section of the shoe sole, the rear end portion of the tubular part is disposed in the vicinity of a rear end of the outer sole, the lower portion of the tubular part is formed in a substantially smooth arc shape in the longitudinal section of the shoe sole, by thus forming the lower portion of the tubular part, the impact load of landing is sequentially imposed on the lower portion from a rear to a front thereof while, during running, a heel contact stance in which a heel of the foot lands on the ground is being switched to a foot flat stance in which almost whole of a sole of the foot is in contact with the ground, and the lower portion of the tubular part, subjected to the impact load, sequentially undergoes bending deformation from the rear to the front thereof.

6. A shock absorbing device for a shoe sole according to claim 1, wherein the tubular part is disposed at a rear foot part of the midsole, and at least a part of the lower portion of the tubular part protrudes downwards further than the rear foot part of the midsole.

7. A shock absorbing device for a shoe sole according to claim 1, wherein the tubular part is disposed at a rear foot part of the midsole, and substantially whole of the lower portion of the tubular part protrudes downwards further than the rear foot part of the midsole.

8. A shock absorbing device for a shoe sole according to claim 1, wherein the deformation element is provided at least on a lateral side of a rear foot part of the foot.

9. A shock absorbing device for a shoe sole according to claim 8, wherein at least two deformation elements are provided separately from each other in a medial-lateral direction of the foot.

10. A shock absorbing device for a shoe sole according to claim 8, wherein at least two deformation elements are provided on the lateral side of the rear foot part of the foot.

11. A shock absorbing device for a shoe sole according to claim 1, wherein a shock absorbing member having a smaller Young's modulus than the tubular part is provided in an internal space of the tubular part.

12. A shock absorbing device for a shoe sole according to claim 1, wherein the tubular part has a front end portion in front of the lower portion and a rear end portion in the rear of the lower portion, and external surfaces of the two end portions are covered with the midsole and/or the outer sole.

13. A shock absorbing device for a shoe sole according to claim 1, wherein the tubular part is integrally formed to be seamless in a longitudinal section of the shoe sole.

14. A shock absorbing device for a shoe sole according to claim 1, wherein Young's modulus of the material constituting the tubular part is set within a range of about 1 k g/mm$^2$ to about 30 kg/mm$^2$.

15. A shock absorbing device for a shoe sole according to claim 1, wherein at least two deformation elements are provided at a rear foot part of the foot, and the deformation elements provided at the rear foot part are spaced apart from each other in a longitudinal direction of the foot.

16. A shock absorbing device for a shoe sole according to claim 1, wherein the tubular part has a front end portion in front of the lower portion and a rear end portion in the rear of the lower portion, at least two deformation elements are provided at a rear foot part of the foot, the deformation elements including a first deformation element and a second deformation element, the first deformation element is disposed so that the rear end portion of the tubular part of the first deformation element is in a vicinity of a rear end of the outer sole, and the second deformation element is disposed so that the front end portion of the tubular part of the second deformation element is in a vicinity of a rear end of an arch of the midsole.

17. A shock absorbing device for a shoe sole according to claim 16, wherein the front end portion of the tubular part of the first deformation element and the rear end portion of the tubular part of the second deformation element are close to each other in the longitudinal direction of the foot.

18. A shock absorbing device for a shoe sole according to claim 17, wherein the first deformation element is disposed on a rear lateral side of the rear foot part of the foot, and the second deformation element is disposed on a front medial side of the rear foot part of the foot.

19. A shock absorbing device for a shoe sole comprising:

an outer sole having a ground contact surface that contacts the ground at landing and an upper surface opposite to the ground contact surface;

a midsole that is disposed above the outer sole and has a bottom surface; and a deformation element disposed between the outer sole and the midsole, wherein the deformation element is joined to the bottom surface of the midsole and is joined to the upper surface of the outer sole, the deformation element has a tubular part in a flat tubular form, Young's modulus of a material constituting the tubular part is greater than both that of a material constituting the midsole and that of a material constituting the outer sole, the tubular part is arranged so as to have a major axis generally along a longitudinal direction of a foot and a minor axis generally along a vertical direction, a length of the major axis is set within a range of about 25 mm to about 80 mm, the tubular part has a lower portion that is curved so as to be convex downwards and thereby undergoes bending deformation due to an impact load of landing, a concave first curved surface is provided on the upper surface of the outer sole, the lower portion of the tubular part fits into the first curved surface of the outer sole, the deformation element is provided at least on a lateral side of a rear foot part of the foot, at least two deformation elements are provided separately from each other in a medial-lateral direction of the foot, and the minor axis of the tubular part becomes shorter as it gets closer to a center in the medial-lateral direction of the foot.

20. A shock absorbing device for a shoe sole comprising:

an outer sole having a ground contact surface that contacts the ground at landing and an upper surface opposite to the ground contact surface;

a midsole that is disposed above the outer sole and has a bottom surface; and a deformation element disposed between the outer sole and the midsole, wherein the deformation element is joined to the bottom surface of the midsole and is joined to the upper surface of the outer sole, the deformation element has a tubular part in a flat tubular form, Young's modulus of a material constituting the tubular part is greater than both that of a material constituting the midsole and that of a material constituting the outer sole, the tubular part is arranged so as to have a major axis generally along a longitudinal direction of a foot and a minor axis generally along a vertical direction, a length of the major axis is set within a range of about 25 mm to about 80 mm, the tubular part has a lower portion that is curved so as to be convex downwards and thereby undergoes bending deformation due to an impact load of landing, a concave first curved surface is provided on the upper surface of the outer sole, the lower portion of the tubular part fits into the first curved surface of the outer sole, the tubular part has an upper portion that is curved so as to be convex upwards and thereby undergoes bending deformation due to the impact load of landing, a concave second curved surface is provided on the bottom surface of the midsole, the upper portion of the tubular part fits into the second curved surface of the midsole, the tubular part has a front end portion in front of the lower portion and a rear end portion in the rear of the lower portion, and a thickness of the end portion is greater than both that of the upper portion and that of the lower portion.

21. A shock absorbing device for a shoe sole according to claim 20, wherein the thickness of the end portion is set within a range of about 1.5 mm to about 8.0 mm and the thickness of the upper portion and the thickness of the lower portion are each set within a range of about 1.0 mm to about 4.0 mm.

* * * * *